United States Patent [19]

Pettinga et al.

[11] Patent Number: 4,700,608

[45] Date of Patent: Oct. 20, 1987

[54] MACHINE GUN

[75] Inventors: Robert Pettinga, Shelburne; Joseph Dix, Williston; Thomas O. McHugh, Burlington; Lincoln L. Sibley, Jr., Burlington; Richard T. Ziemba, Burlington; Victor J. Forrester, Burlington, all of Vt.

[73] Assignee: General Electric Company, Burlington, Vt.

[21] Appl. No.: 793,013

[22] Filed: Oct. 30, 1985

[51] Int. Cl.[4] ..... F41F 9/00

[52] U.S. Cl. ..... 89/11; 89/1.4; 89/1.41; 89/33.25; 89/127; 89/186

[58] Field of Search ..... 89/1.4, 1.41, 9, 11, 89/33.2, 33.25, 126, 127, 128, 186

[56] References Cited

U.S. PATENT DOCUMENTS

| | | | |
|---|---|---|---|
| 390,114 | 9/1888 | Burton | 89/126 |
| 623,003 | 4/1899 | Garland | 89/126 |
| 636,974 | 11/1899 | Garland | 89/126 |
| 1,332,060 | 2/1920 | Pacilli | 89/126 |
| 1,351,017 | 8/1920 | Blackmore | 89/126 |
| 1,477,115 | 12/1923 | Gast | 89/126 |
| 1,856,022 | 4/1932 | Blacker | 89/126 |
| 2,509,734 | 5/1950 | Higson | 89/126 |
| 2,966,830 | 1/1961 | Hepperle | 89/1.4 |
| 2,972,286 | 2/1961 | Marquardt | 89/126 |

FOREIGN PATENT DOCUMENTS

| | | | |
|---|---|---|---|
| 3208942 | 9/1983 | Fed. Rep. of Germany . | |
| 435603 | 9/1935 | United Kingdom | 89/1.4 |

*Primary Examiner*—Stephen C. Bentley
*Attorney, Agent, or Firm*—Bailin L. Kuch

[57] ABSTRACT

This invention provides the provision of a machine gun having a pair of gun barrels fixed to the receiver with a pair of operating mechanism driven by a rocking lever and each operating mechanism including a reciprocating slider which drives a reciprocating gun bolt assembly and a forward stripper which also serves to lock the gun bolt assembly.

12 Claims, 45 Drawing Figures

MACHINE GUN

BACKGROUND OF THE INVENTION

1. Field of the Invention

This invention relates to machine guns having two gun barrels and a linkage which alternatively drives each breech bolt via a cam operated accelerator.

2. Description of the Prior Art

Two barreled machine guns having the recoil of the exploded charge in one barrel loading and locking the charge in the other barrel have been shown in the following U.S. Pat. Nos.:

390,114, issued Sept. 29, 1888, to B. Burton;
623,003, issued Apr. 11, 1899, to F. M. Garland;
636,974, issued Nov. 14, 1899, to F. M. Garland;
1,332,060, issued Feb. 24, 1920, to L. Paeilli;
1,351,017, issued Aug. 31, 1920, to C. C. Blackmore;
1,477,115, issued Dec. 11, 1923, to C. Gast;
1,856,022, issued Apr. 16, 1932, to L. V. S. Blacker; and
2,972,286, issued Feb. 21, 1961, to F. R. Marquardt.

SUMMARY OF THE INVENTION

It is an object of this invention to provide a lightweight, high rate of fire, gun mechanism for a two barrel gun which can be driven either by an external drive or a gun gas drive.

Another object is to provide a breech bolt, bolt accelerator and locking mechanism for a two barrel gun having a rocking lever to synchronize the sets of mechanisms.

Yet another object is to provide a mechanism for a two barrel gun wherein a linear motion input from the external drive imparts an oscillatory motion to the rocking lever.

A feature of this invention is the provision of a machine gun having a pair of gun barrels fixed to the receiver with a pair of operating mechanisms driven by a rocking lever and each operating mechanism including a reciprocating slider which drives a reciprocating gun bolt assembly and a forward stripper which also serves to lock the gun bolt assembly.

BRIEF DESCRIPTION OF THE DRAWING

These and other objects, features and advantages of the invention will become apparent from the following specification thereof taken in conjunction with the accompanying drawing in which.

DESCRIPTION OF THE INVENTION

Figure 1:
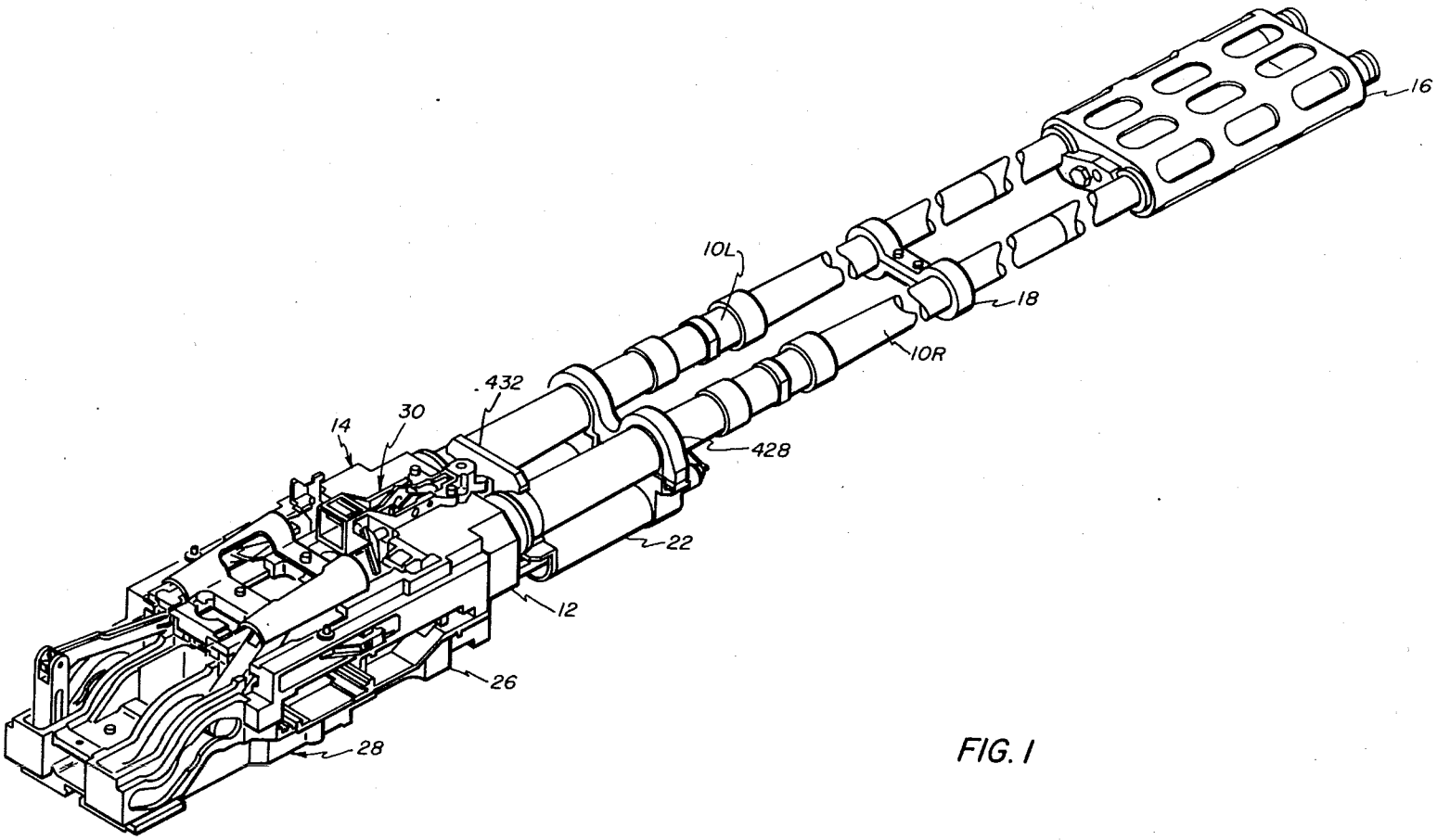
FIG. 1 is a perspective view of a gun embodying this invention.
Figure 2:
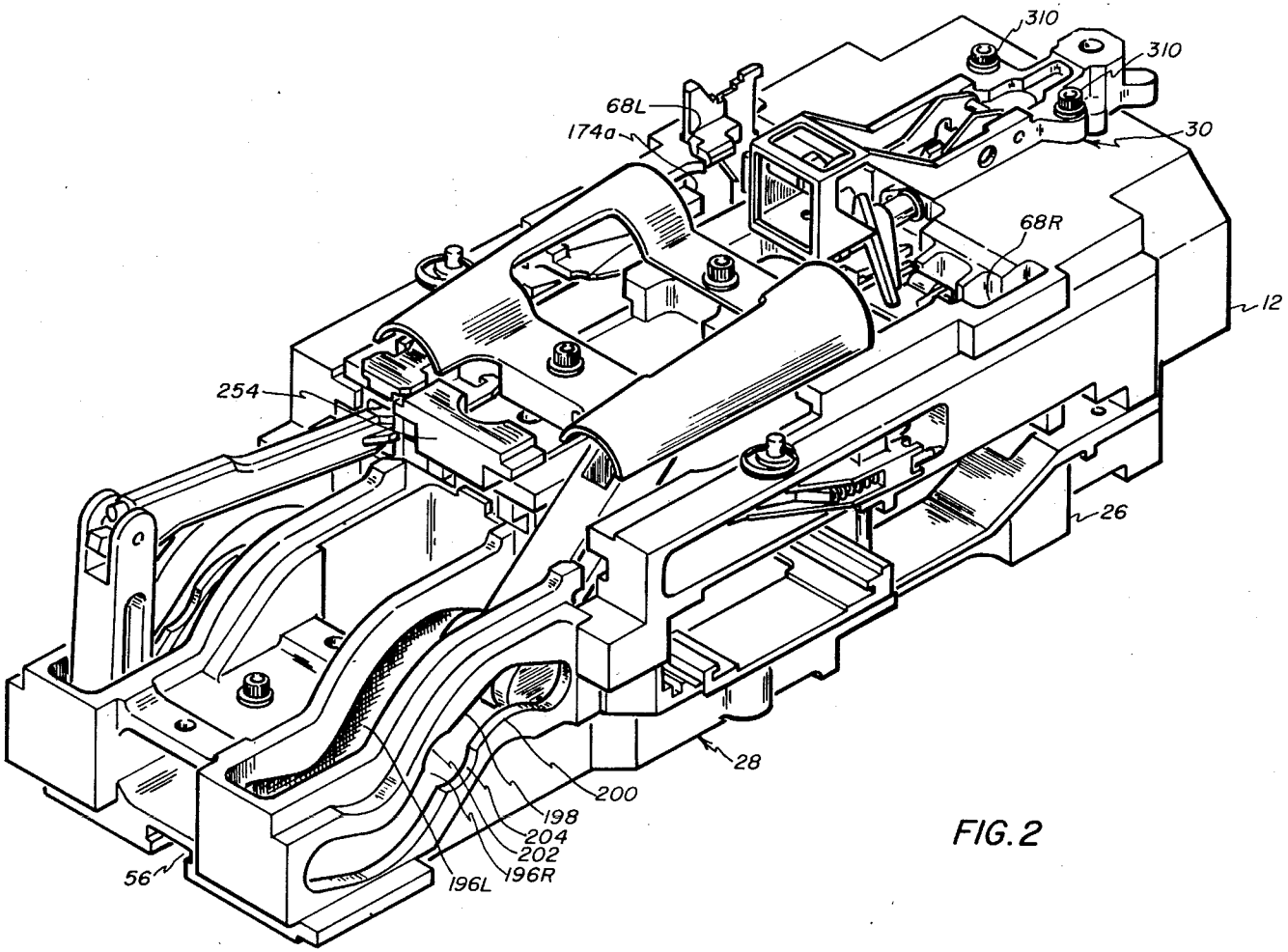
FIG. 2 is a detail of FIG. 1 showing the breech and receiver assembly.
Figure 3:
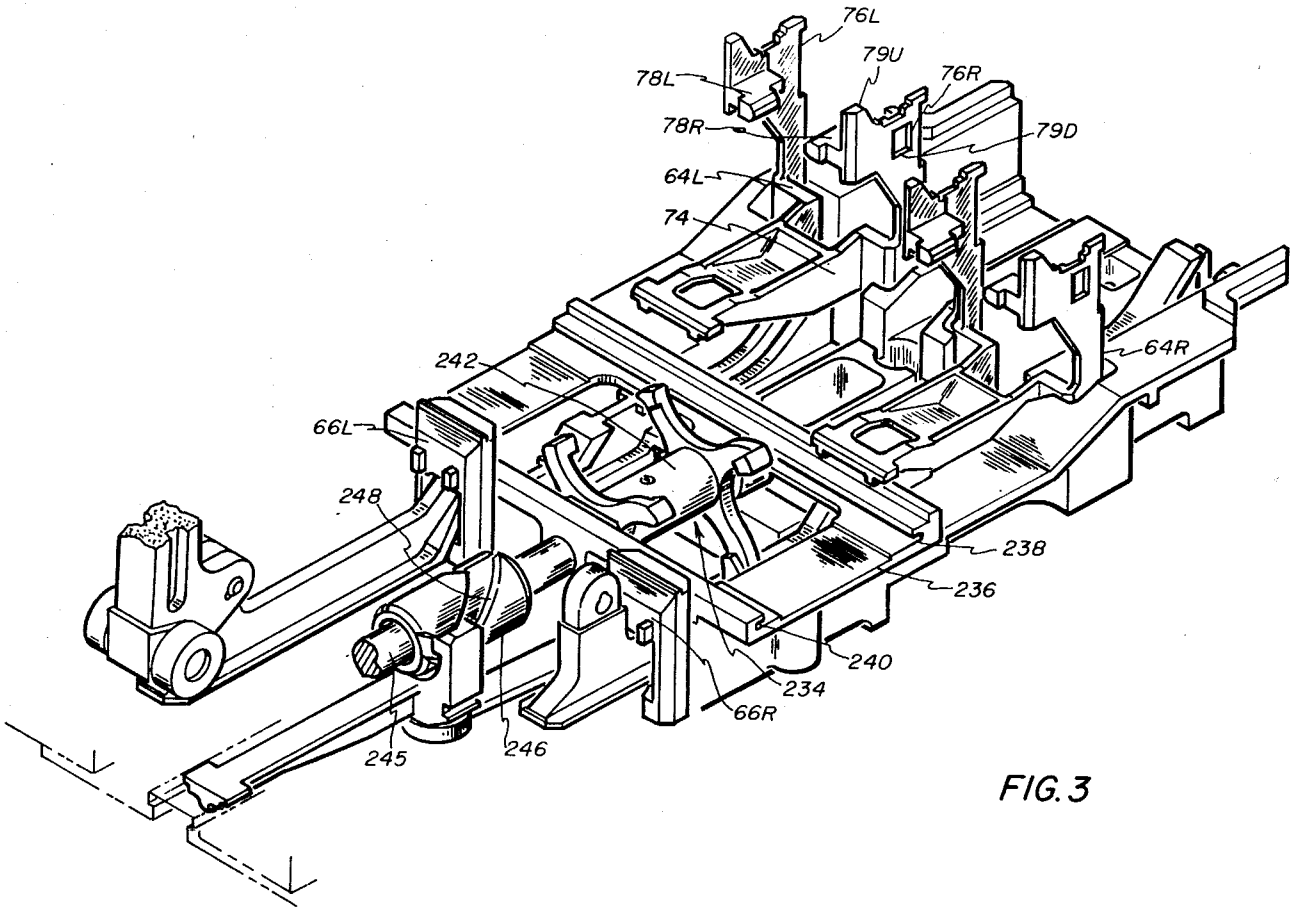
FIG. 3 is a detail of FIG. 2 showing the feeder mechanism.
Figure 3A:
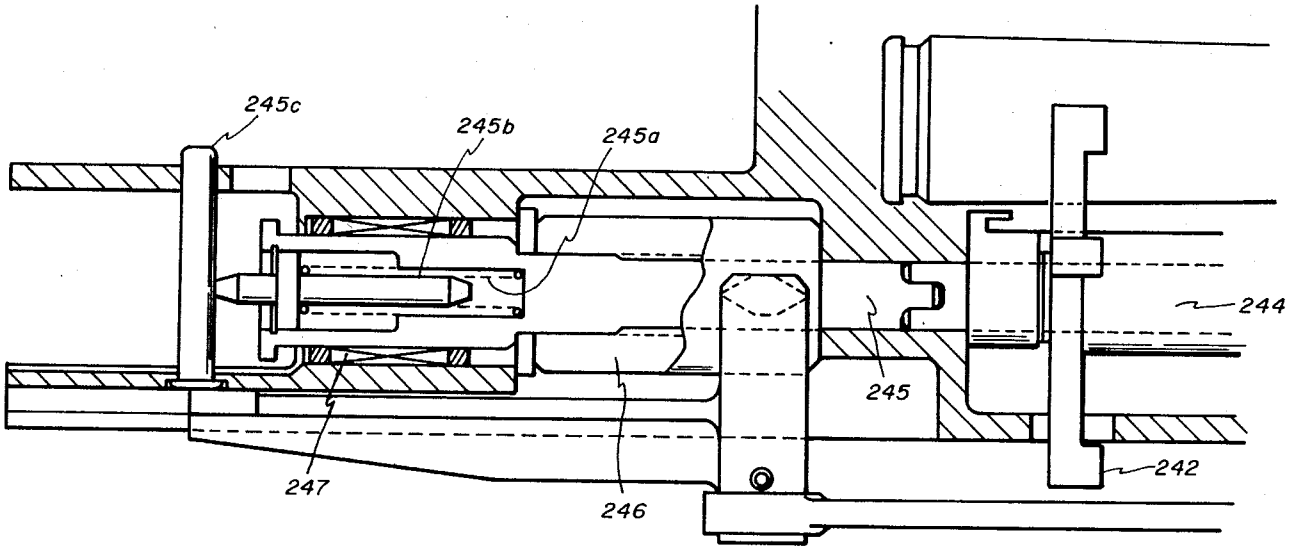
FIG. 3A is a detail of FIG. 3 in cross-section along a vertical, longitudinal plane showing the feeder shafts.

As seen in FIG. 1, the gun includes a left hand gun barrel 10L and a right hand gun barrel 10R which are secured to a breech housing 12 of a breech assembly 14. The barrels are also constrained by a muzzle clamp assembly 16, a mid-barrel clamp assembly 18, and an aft clamp assembly which is part of a gas drive assembly 22 and is shown in FIG. 1, and in FIGS. 38 through 41, for driving the gun, but this gas drive assembly may be deleted and the externally powered drive assembly shown in FIGS. 42 and 43 or the externally powered drive assembly shown in FIG. 44 may be substituted therefor. The breech housing 12 is fixed to a receiver housing 26 in a receiver assembly 28. A hammer assembly 30 is also fixed to the breech housing 12. The breech and receiver housings may be considered together to be the classical "receiver".

Figure 4:
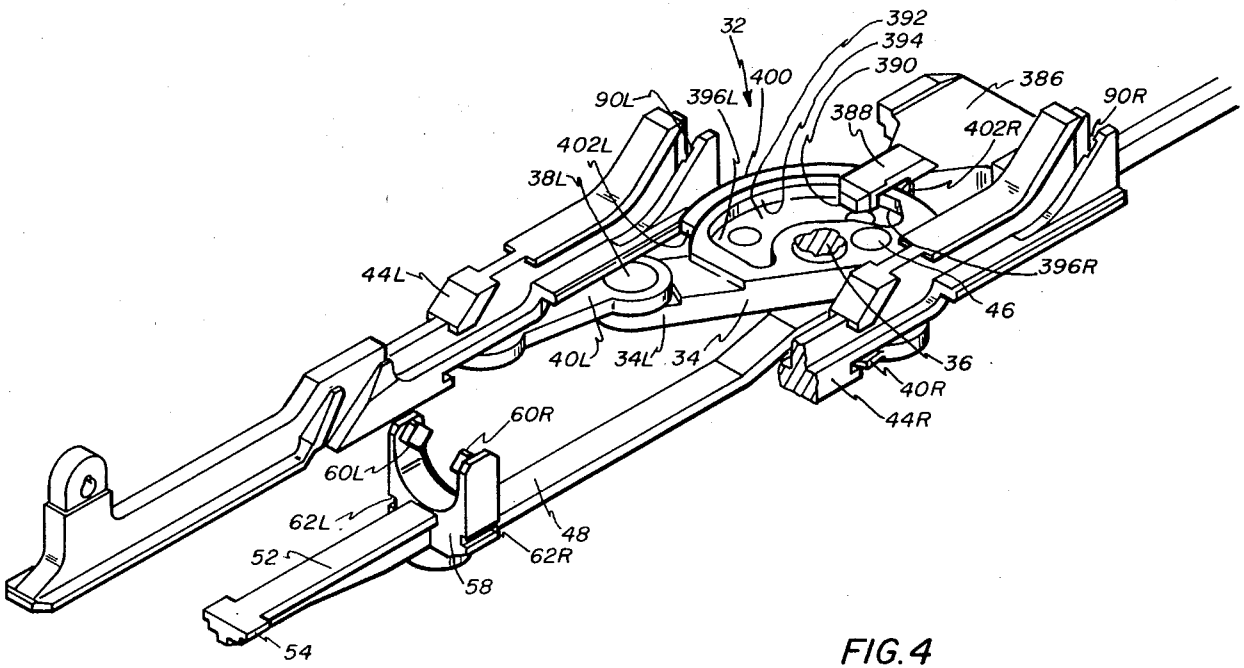
FIG. 4 is a detail of FIG. 2 showing the operating linkages.
Figure 5:
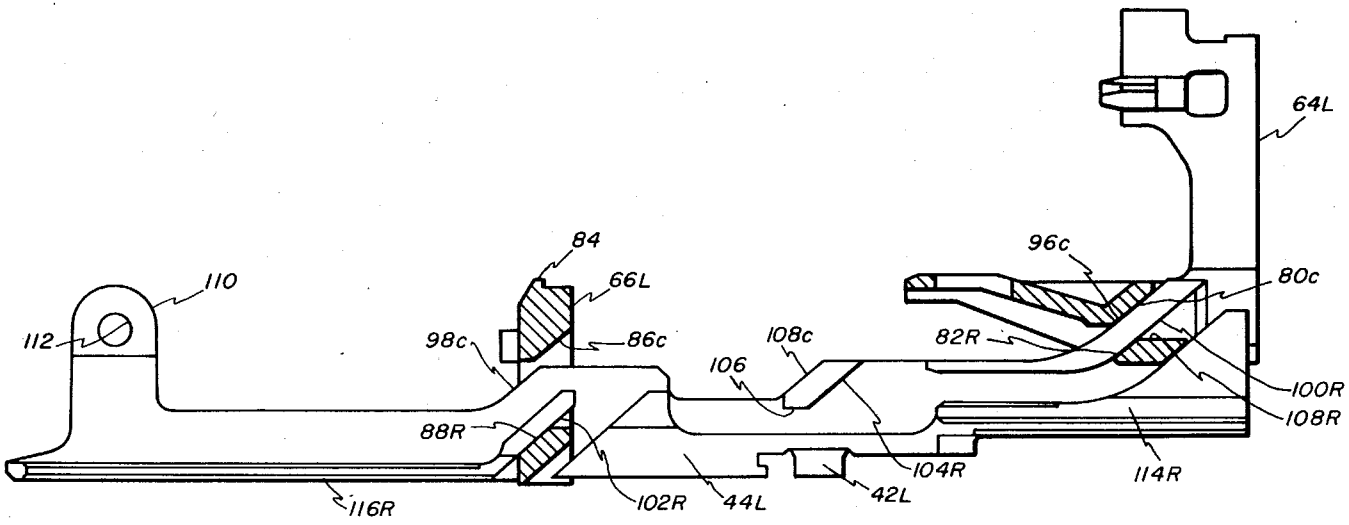
FIG. 5 is a side view in elevation of the left hand slider, the left hand aft stripper and the left hand forward stripper.

As seen in FIG. 4, the operating mechanism 32 is mainly disposed within the receiver housing 26 and is included in the receiver assembly 28. This operating mechanism includes a rocking lever 34 which is fixed to a central post 36, and which post is journaled for oscillation to the receiver housing 26. The rocking lever 34 has a left arm 34L to which is fixed a left post 38L which is journaled to the forward end of a left link 40L, and has a right arm (not visible) to which is fixed a right post (not visible) which is journaled to the forward end of a right link 40R. The aft end of the left link 40L is journaled to a left post 42L which is fixed to a left slider 44L. The aft end of the right link 40R is journaled to a right post (not visible) which is fixed to a right slider 44R which is identical to the left slider 44L. The aft end of each link 40L/R has a projection 40P which is captured in a respective notch in the respective slider 44L/R to capture the link to its respective post 42L/R. An additional post 46 is fixed to the rocking lever 34 and is journaled to the forward end of a feeder arm 48. The aft end of the feeder arm 48 has a post not visible to which is pivotally journaled a tail slider 52. The aft end of the slider has a cross-piece 54 which rides in a channel 56 in the receiver housing 26. The forward end of the slider 52 has a cam driver 58 with two mutually spaced apart upstanding arms which terminate in mutually opposed cam driving elements 60L and 60R. The cam driver 58 also has a pair of slots 62L and 62R which ride on a pair of tracks (not visible) in the receiver housing. The cam driver 58 is thereby constrained to rectilinear reciprocating movement when driven by the feeder arm 48 whose forward end is free to oscillate laterally while reciprocated fore and aft by the rocking lever 34.

The operating mechanism also includes a left forward stripper 64L, a right forward stripper 64R, a left aft stripper 66L and a right aft stripper 66R. The forward strippers are disposed in respective vertical passageways 68L and 68R in the breech housing 12 and (not visible) in the receiver housing 26. The aft strippers are disposed in respective vertical passageways (not visible) in the receiver housing 26. Each forward stripper includes a base portion 74 and two upstanding arms 76L and 76R each having a respective, inwardly directed lug 78L and 78R, and a hammer upper camming surface 79U and a hammer lower camming surface 79D. Each base 74 of each forward stripper has a respective diagonally downwardly facing cam 80C and a part of diagonally-upwardly facing cam surfaces 82L/R. Each aft stripper 66 has a respective upwardly directed lip 84, a diagonally-downwardly facing cam surface 86C and a pair of diagonally-upwardly facing cam surfaces 88L/R.

Each of the sliders 44L/R has a transverse slot 90 in its forward end which receives a disk 92L/R on the end of a respective piston rod 94L/R in the gas drive assembly 22. As each piston rod is reciprocated by the gas drive assembly it reciprocates the thereto engaged slider. The two sliders, by means of the respective links 40L/R, oscillate the rocking lever 34 about its central post 36.

Each of the sliders 44L/R has a respective diagonally-upwardly facing cam surface 96C adapted to drive the stripper cam surface 80C upwardly to bring the respective forward stripper up to engage the nose of a round which is to be stripped from its link, and has a diagonally-upwardly facing cam surface 98C adapted to drive the stipper cam surface 86C to bring the respective aft stripper up to engage the base of a round which is to be stripped from its link.

Each of the sliders 44L/R has a respective pair of diagonally-downwardly facing cam surfaces 100L/R adapted to drive the respective pair of forward stripper cam surfaces 82L/R downwardly to bring the respective stripper downwardly, and has a respective pair of diagonally-downwardly facing cam surfaces 102L/R adapted to drive the respective pair of stripper cam surfaces 88L/R downwardly to bring the respective aft cam stripper downwardly, the motion of the strippers being required before the breech bolt begins its ram stroke.

Each of the sliders 44L/R has a respective pair of diagonally-downwardly directed cam surface 104L/R to drive the respective pair of stripper cam surfaces 82L/R further downwardly to bring the respective forward stripper further down into its gun bolt locking disposition, and has a respective pair of downwardly facing cam surfaces 106L/R to over-ride a respective pair of upwardly facing cam surfaces 108L/R on the forward stripper to maintain such forward stripper in its gun bolt locking disposition.

Each of the sliders 44L/R has a respective cam surface 108C to drive the respective stripper cam surface 80C upwardly to bring the respective forward stripper out of its gun bolt locking disposition.

Each of the sliders 44L/R has a respective upstanding ear portion 110 with a cross bore 112 therethrough, and has a forward pair of outwardly-laterally-extending tracks 114L/R and an aft pair of outwardly-laterally-extending tracks 116L/R. These tracks ride in fore-aft extending respective tracks (not visible) in the receiver housing 26.

Each of a pair of gun bolt assemblies 118L/R respectively includes a bolt head assembly 120L/R, a connecting link 122L/R and an accelerator link 124L/R. Each bolt head assembly 120L/R includes a bolt head body 126L/R having an interior cavity 128 with an aftwardly directed opening 130 to the body aft face 132, and upwardly directed opening 134 to the body top face 136, and a forwardly directed opening 138 to the body front face 140. Each body 126L/R also has a pair of upper extractor lugs 142L/R and a pair of lower extractor lugs 144L/R which are adapted to enter the extractor groove 146 forward of the base 148 of the cartridge case 150 of rounds 152 of ammunition. Each body also has a pair of mutually spaced apart, upwardly directed ears 154L/R with a respective cross-bore 156L/R. A firing pin 158 is mounted in each bolt head and includes an upper head 160 over lying the bolt top face and extending aftwardly from an elbow 162 with a cross-bore 164 which is pivotally secured between the ears 154L/R by a cross-pin 166 through the bores 156L/R and 164, a leg 168 extending downwardly from said elbow through the opening 134 into the cavity 128 and terminating in a penetrator 170 extending through the opening 138. When the base 148 of a cartridge case 150 is held against the front bolt face 140 it presses against the top of the penetrator 170 to pivot the distal end of the head 160 upwardly. When the head 160 is struck downwardly by the hammer assembly 30 it pivots the penetrator forwardly into the primer cup in the base 148 of the cartridge case to fire the round of ammunition. After firing, as the bolt head moves upwardly in unlocking, the base of the case moves relatively downwardly on the bolt face, and the primer cup presses on the upper surface of the tip to pivot the tip aftwardly into the bolt head. The bolt head body 126 also has a pair of laterally extending channels 172L/R adapted to receive respective tracks (not visible) in the breech housing 12 and the lugs 78L/R respectively in the respective forward stripper 64L/R. The four aft surfaces 173*a, b, c* and *d* serve as locking lugs for the bolt head body 126 and abut adjacent surfaces 174*a, b, c* and *d* (174*b, c* and *d* not visible) on the breech housing which serve as locking lugs for the breech. The bolt head body is shifted vertically into lock and unlock disposition by the respective forward stripper through the engagement of forward stripper lugs 78L/R with the bolt head body channels 172L/R.

Figures 6, 7:
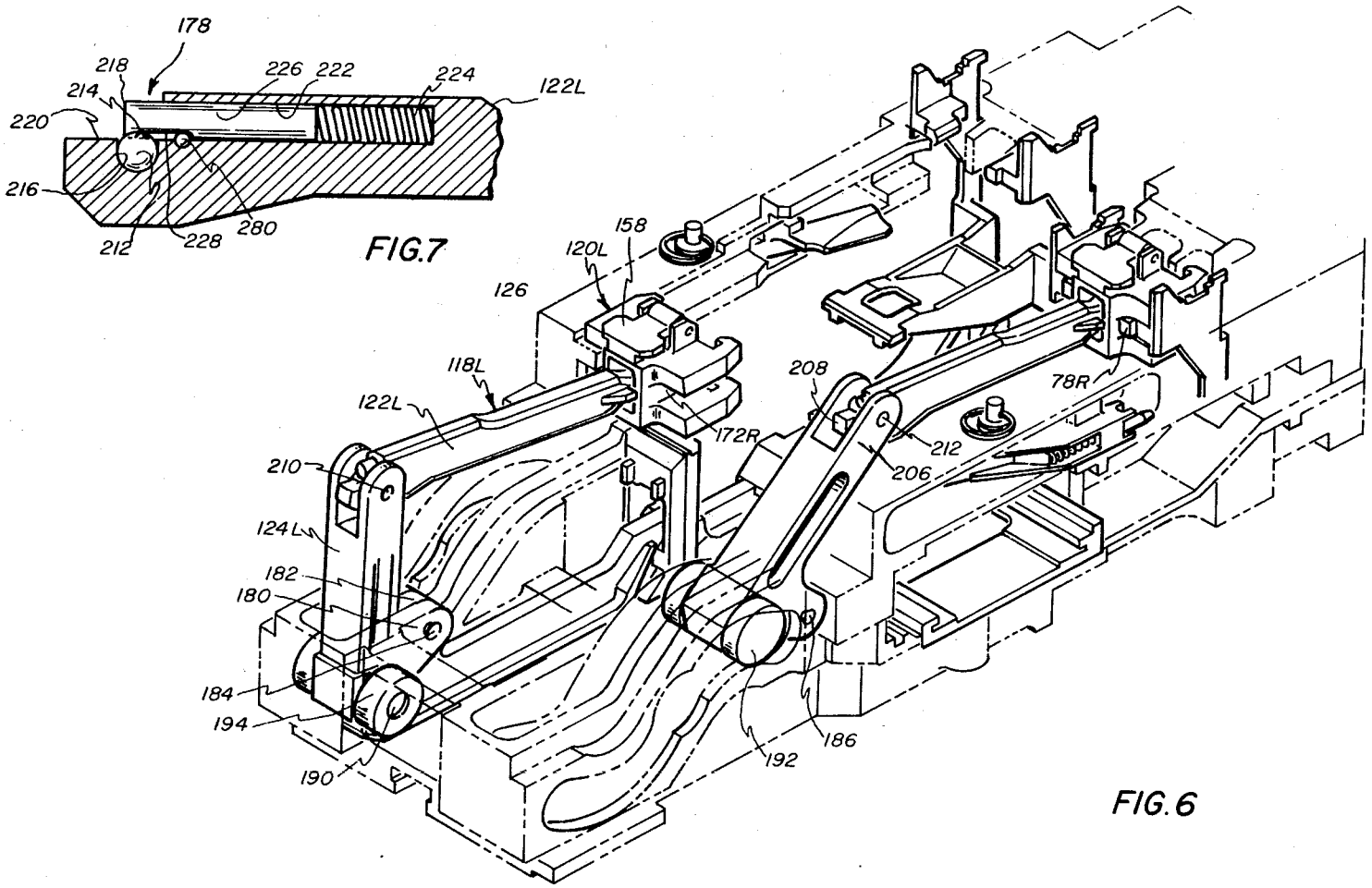
FIG. 6 is a detail of FIG. 2 showing the gun bolts and their linkages.
FIG. 7 is a detail of FIG. 6 showing the quick release connection between the gun bolt rod and the accelerator rod.
Figure 6A:
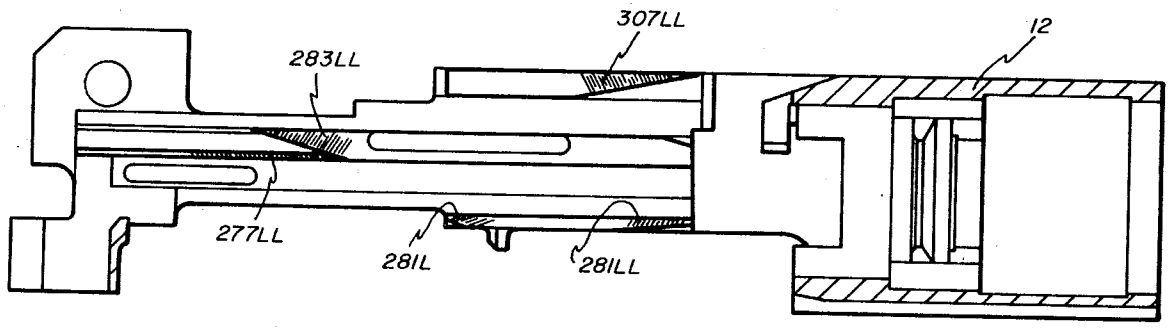
FIG. 6A is a detail of FIG. 6 showing various guide surfaces on the breech housing.

Each connecting link 122L/R has a forward end with a cross-bore 175 disposed within the cavity 128 and which is pivotally held to the bolt body 126 by a cross-pin 176 disposed in the cross-bore 175 and in two aligned bores (not visible) in the bolt body 126. The link has an aft end with a quick release assembly 178 shown in FIG. 7.

Each accelerator link 124L/R has a lower portion terminating in a forwardly extending clevis 180 having a central slot 182 defined by the two ears of the clevis 180 and having a cross-bore 184L/R through each of the ears respectively. The aft ear 110L/R of the respective slider 44L/R is disposed within the slot 182 and is pivotally held to the clevis by a cross-pin 186 through the cross-bore 112 and the cross-bores 184L/R. The lower portion also has a cross-bore (not visible) through which passes a shaft 190 which has an outer hand cam roller 192 integral therewith and an inner hand cam roller 194 journaled thereon. These cam rollers ride on respective S-shaped cam surfaces 196L/R in the receiver housing 26 which has upper and lower outer-upstanding lips 198 and 200 to preclude the assembly of cam rollers 192 and 194 from leaving the cam surfaces. Respective notches 202 and 204 are cut in the lips to permit the transverse entry of the rollers when the link is assembled into the housing.

Each accelerator link 124L/R has an upper portion terminating in a upwardly extending clevis 206 having a central slot 208 defined by the two ears of the clevis and having cross-bores 210L/R through each of ears respectively. A cross-pin 212 is disposed through the cross-bores 210L/R across the slot 208 and has a cross-notch 214 of semi-circular transverse cross-section. The quick release assembly 178 interengages the clevis 206 and cross-pin 212 to provide a pivotable joint between the accelerator link 124 and the connecting link 122. The quick release assembly 178 includes a cross-bore 216 through the aft end portion of the connecting link and a notch cutting away a corner of the end portion to the cross-bore 216 to provide an aft face 218 which is tangential to the circumference of the cross-bore 216 and an upper face 220 which is perpendicular to the aft face 218 and has an opening equal to the diameter of the pin. These two faces and the remaining circumferential wall of the cross-bore will pass the cross-pin 212 when the end portion of the connecting link is moved into the proximal portion of the slot 208 and will nest the cross-pin 212 into the cross-bore 216 when the end portion is moved towards the distal portion of the slot 208. The end portion has a longitudinal blind bore 222 in which are disposed a helical compression spring 224 and a plunger-rod 226. The plunger-rod has a longitudinally extending flat 228 which passes a cross-pin 230 which is fixed in a transverse bore in the aft end portion of the connecting link through the longitudinal blind bore 222. The compression spring 224 biases the plunger-rod 226 aftwardly, within the constraint provided by the flat 228 and thr cross-pin 230, so that the distal end of the plunger rod 226 is disposed within the notch 214 of the cross-pin 212 to capture the cross-pin 212 to the quick release assembly 178. To disconnect the connecting link 122 from its respective accelerator link 124, the plunger-rod 226 is pressed, against the bias of the spring 224, out of the notch 214 and the quick release assembly is unhooked from the cross-pin 212.

The accelerator link 124, in conjunction with the S-shaped cam surface 196, converts the motion of the slider 44 provided by the gun drive mechanism into the motion required for the operating cycle of the gun bolts.

An ammunition feeder assembly 234 is disposed within the receiver housing 26 and includes a transverse guide 236 having a forward groove 238 and an aft groove 240 to guide the forward and aft ends of links 241 which form the ammunition belt, here shown as a left hand feed. The links are of the side stripping type wherein each round of ammunition provides a pivotal interconnection between immediately adjacent links. A four toothed sprocket 242 is fixed to a longitudinally extending forward feeder shaft 244 whose forward and aft ends are journaled for rotation in the receiver housing. A drum cam 246, having four terminally interconnected helical grooves 248, is splined to an aft shaft 245. The aft end of the shaft 244 is slotted to slidably receive the blade forward end of the aft shaft 245 whose aft end is journaled in the longitudinal bore of a one-way clutch 247 which serves as its aft end journal in the receiver housing. A helical compression spring 245*a* is captured between a plunger 245*b* held by a crosspin 245*c* to bias the aft shaft blade into the slot. The blade may be manually withdrawn to permit reverse rotation of the forward shaft to permit the ammunition belt to be manually withdrawn. The cam driving elements 60L and 60R of the cam driver 58 ride the grooves 248. When the feeder arm 48 is driven aft by the rocking lever 34 the cam driver 58 drives the drum cam, and the shafted thereto sprocket 242 through 90° of clock-wise rotation, and when the feeder arm is driven forward the cam driver drives the drum cam and the sprocket through an additional 90° of clock-wise rotation. Each full cycle of the rocking lever thus advances the ammunition belt by two rounds of ammunition. Considering the leading four rounds in the ammunition belt during left side feed operation, it will be seen that on the aft stroke of the feeder arm the sprocket aligns the second round with the left hand gun bolt and gun barrel and strips that second round from its link, and on the forward stroke of the feeder arm this second round is chambered into the left hand gun barrel, while the sprocket aligns the first round with the right hand gun bolt and gun barrel and strips that first round from its link. On the following aft stroke of the feeder arm this first round is chambered into the right hand gun barrel, while the sprocket aligns the fourth round with the left hand gun bolt and strips it from its link. On the following forward stroke of the feeder arm this fourth round is chambered into the left hand gun barrel, while the sprocket aligns the third round with the right hand gun bolt and strips it from its link. The above described procedure can be done in a right side feed operation by reversing the sprocket, the drum cam, and the one way clutch. The tips of the teeth of the sprocket are spaced apart by a pitch which is slightly greater than the normal, unstressed pitch of the belt of ammunition to accomodate any stretching of the belt.

The stripping of each round is performed by the respective set of forward and aft strippers while the ramming of such round is performed by the respective gun bolt and an array of guides in the breech assembly 14. The guide array includes a center guide 250, a left guide 252L and a right guide 252R as well as the ammunition link and guides machined in the breech housing 12. As seen in FIGS. 12 through 28, the center guide 250 is pivotally mounted on a pin 253 to a longitudinally extending web 254 in the breech housing 12. The guide has a downwardly directed pocket 256 formed therein with an aftwardly extending overhanging lip 258. A detent plate 260 is disposed in the pocket and has a forwardly extending foot 262 under the lip 258 and a helical compression spring 264 captured in an upwardly directed pocket 266. The spring biases the detent plate upwardly about the transverse pivot axis formed by the foot and the lip. The detent plate also has a upwardly extending nose 268 adapted to enter either of two slots (not visible) in the breech housing 12 to retain the center guide in either of its swung left or swung right dispositions, and a left and right cam surface 272L/R which may be overriden by an aftwardly moving bolt head to pivot the detent plate downwardly to disengage its nose 268 from one of said slots. The center guide also has a pocket 274C which receives a downwardly extending projection (not visible) in the breech housing 12 to limit the swing to the left or right of the center guide; and has a left and a right cam surface 276L/R adapted to be abutted by the aftwardly moving bolt head, after the bolt head has released the detent, whereby the bolt head can swing the center guide to the right or left respectively. The center guide also has a left and a right concave upper guide surface 278L/R and a left and a right concave lateral guide surface 280L/R.

The left and right side guides 252L/R each include a forward side guide 282 and an aft side guide 284 which are both pivotally journaled on a pin 286 to the breech housing 12. A compression spring 288 is captured in a concave groove in a slot in an aftwardly extending leg 294 of the forward side guide 282 and biases a forwardly extending foot 296 of the aft side guide 284 which extends into the slot. The aft tips of the leg 294 are thus biased against upper and lower stops 298U/L on the aft side guide 284.

Figure 13:
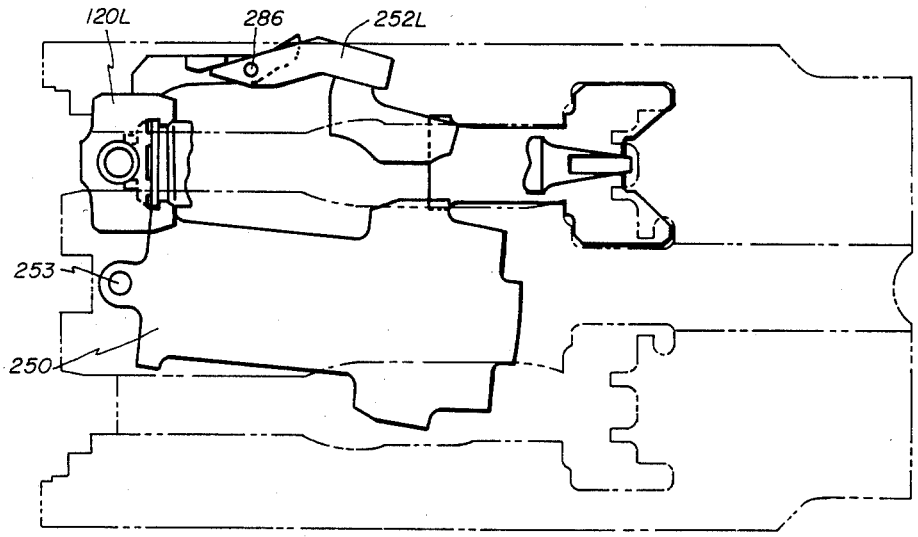
FIGS. 13 and 14 are top and side elevation views respectively of the left hand and center guides, the left hand aft and forward strippers, and the left hand gun bolt cooperating with a round still in its link in the feed disposition.
Figure 14:
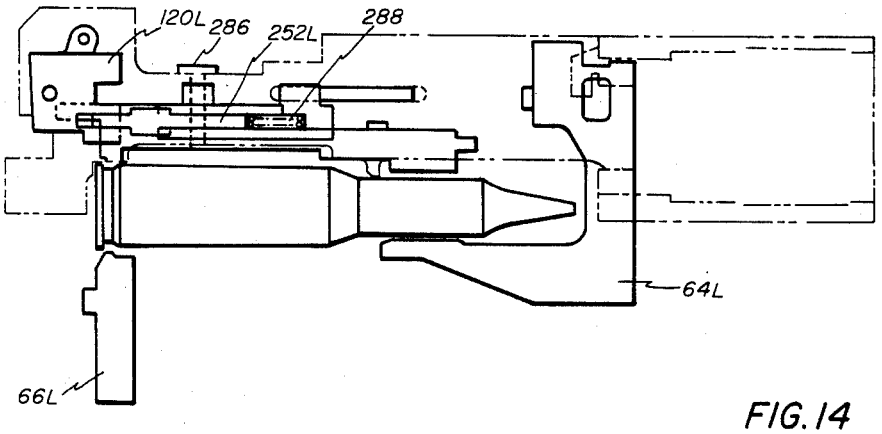

FIGS. 13 and 14 show the left gun bolt head assembly 120L, the left side guide assembly 252L, the center guide assembly 250, the left aft stripper 66L and the left forward stripper 64L in their respective feed dispositions. The left gun bolt head 120L is in rear dwell and abuts the aft end of the aft side guide 284 swinging this aft end outwardly (here seen clock-wise) about the pivot 286, and via the spring 288, swinging the forward end of the forward side guide 282 inwardly over the round which is vertically aligned with the left hand gun barrel and still in its link 241 in the transverse guide 236 under the control of the sprocket 242. Prior to this, the gun bolt while moving aft towards rear dwell had overriden the cam surface 272L to disengage the detent plate 260 from the left hand slot in the housing, and while the detent plate is disengaged, had abuted the lateral cam surface 276L to swing the center guide assembly 20 about its pivot 253 to its swung-right disposition, whereat the detent plate engages the right hand slot in the housing. The left slider 44L has been moving aftwardly and is now about three-fourths aft. The aft and forward strippers 66L and 64L are below the round.

Figure 10:
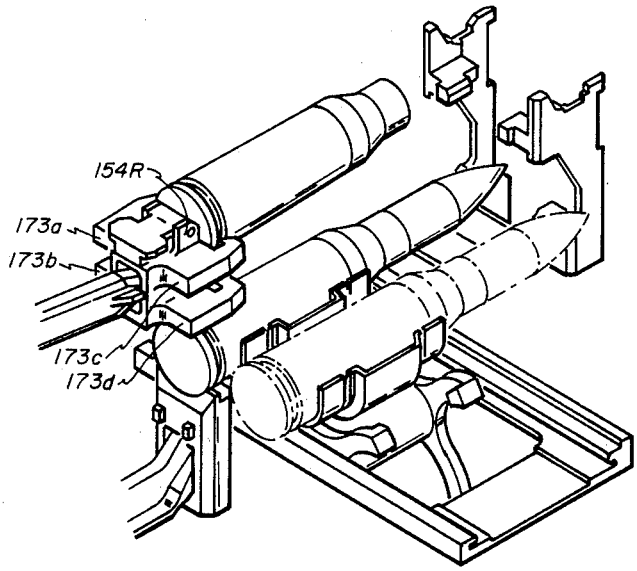
FIG. 10 is a detail perspective view showing the interaction of the strippers with the belt of linked ammunition, here showing the left hand strippers about to strip a round for the left hand gun barrel while the left hand gun bolt holds an extracted cartridge case.
Figure 8:
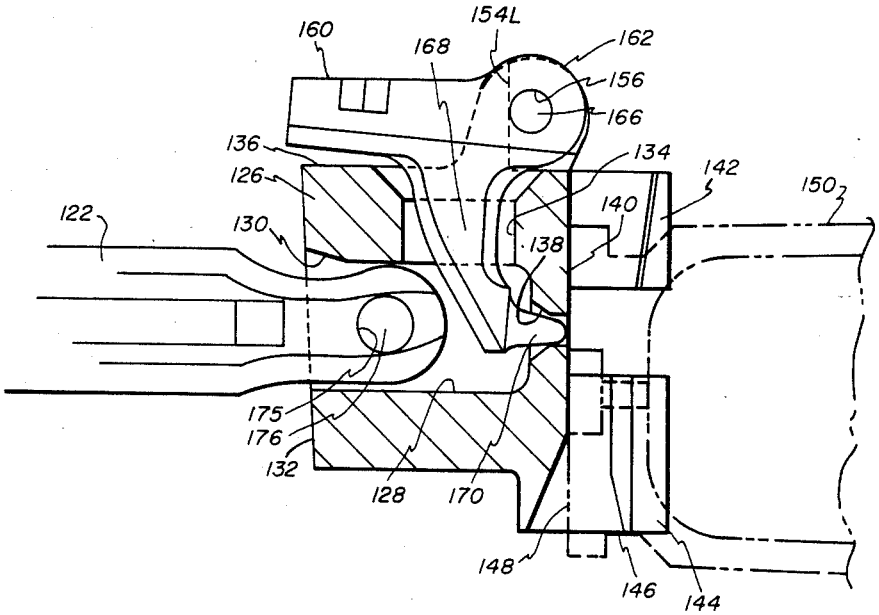
FIG. 8 is a detail side view in elevation of the bolt head with the firing pin in its retracted disposition.
Figure 11:
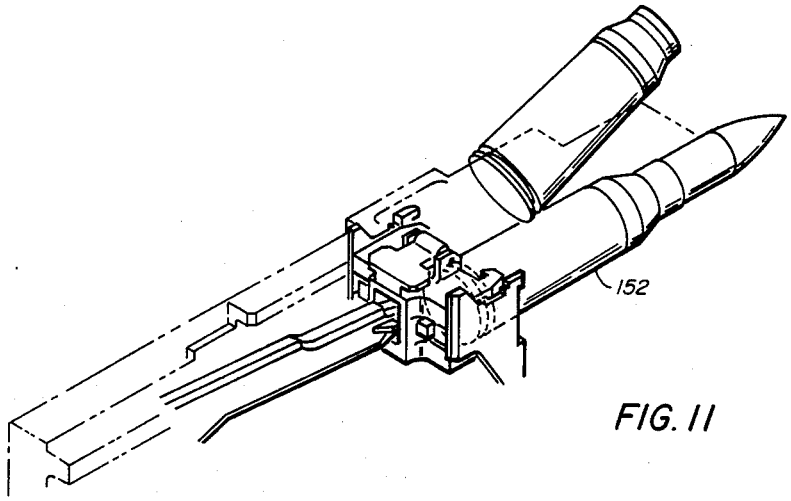
FIG. 11 is a detail perspective view showing the left hand gun bolt locked by the left hand forward stripper as it holds a round in the chamber while the extracted cartridge case has been ejected.
Figure 9:
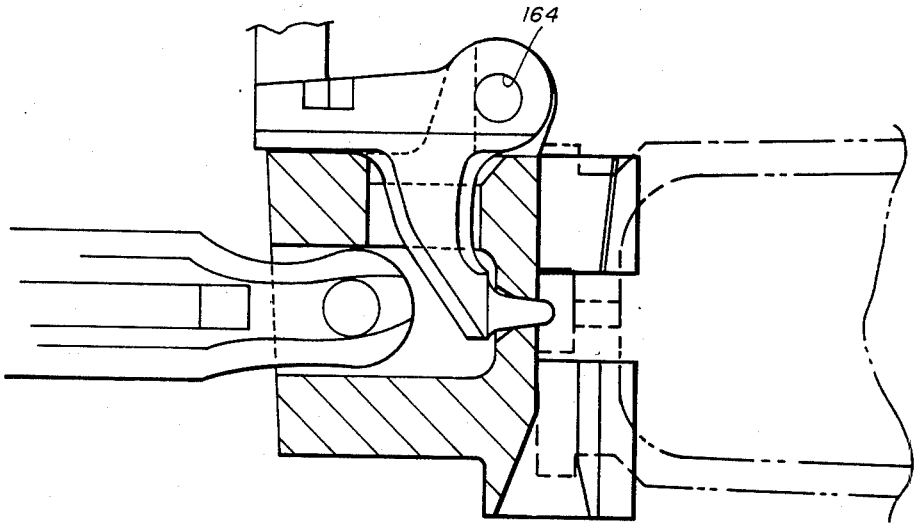
FIG. 9 is a view similar to FIG. 8 but with the firing pin in its fired disposition.
Figure 12:
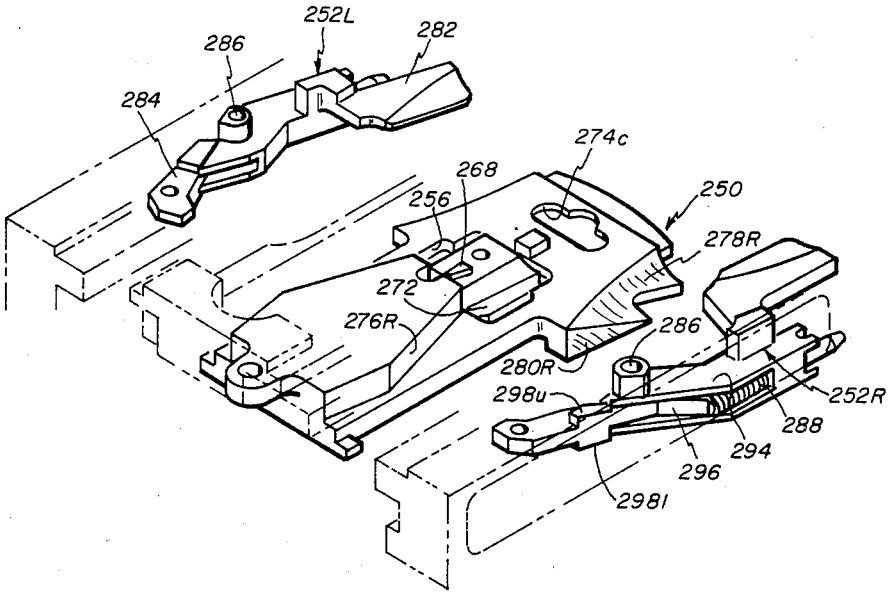
FIG. 12 is a perspective view of the left hand, center, and right hand guide for the rounds as disposed in the breech housing as shown in FIG. 2.
Figure 12A:
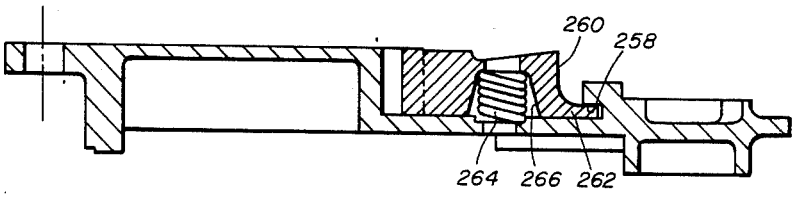
FIG. 12A is a detail cross-section of the center guide of FIG. 12.
Figure 15:
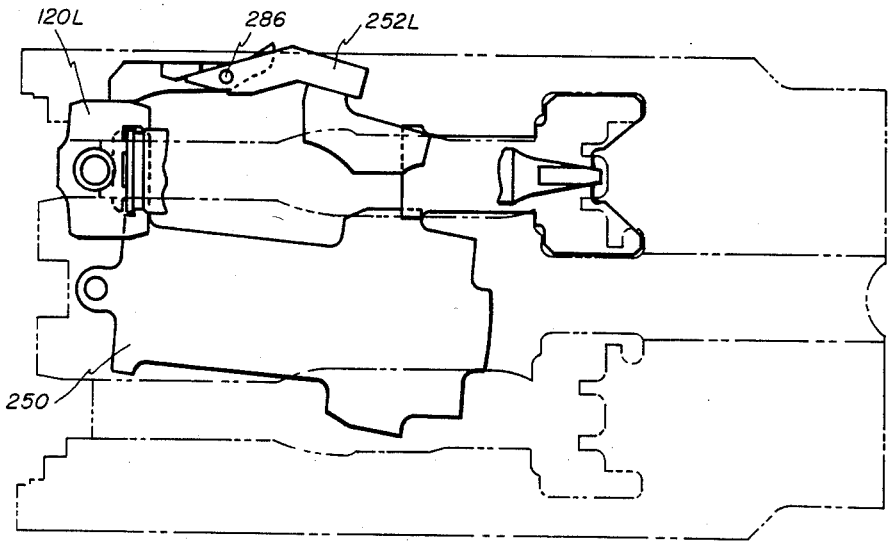
FIGS. 15 and 16 are similar to FIGS. 13 and 14 but show the round stripped from its link.
Figure 16:
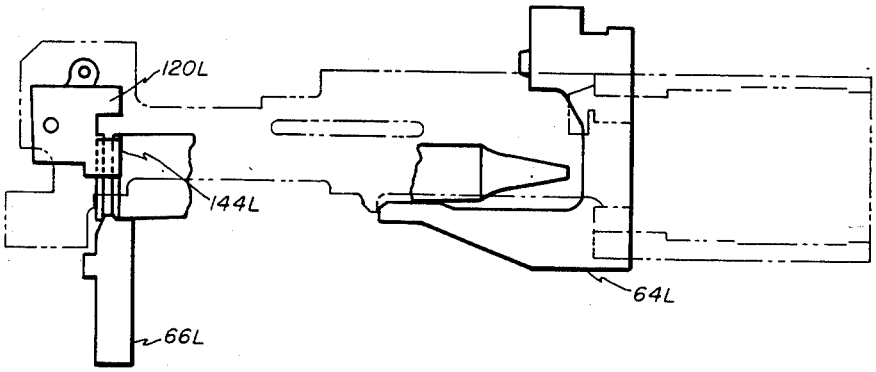

FIGS. 15 and 16, and also FIG. 10, show the round stripped out of its link by the aft and forward strippers 66L and 64L which were raised by the still aftwardly moving left slider 44L. The left gun bolt head 120L remains in rear dwell and an upper portion of the base of the cartridge case is now on a lower portion of the face of the gun bolt, with the extractor disk of the case engaged by the lower extractor lugs 144L/R. Upward movement of the base of the case is limited by a pair of mutually facing surfaces 277LL and 277LR, while the shoulder of the case is limited by the lower face of the forward side guide 282L.

Figure 17:
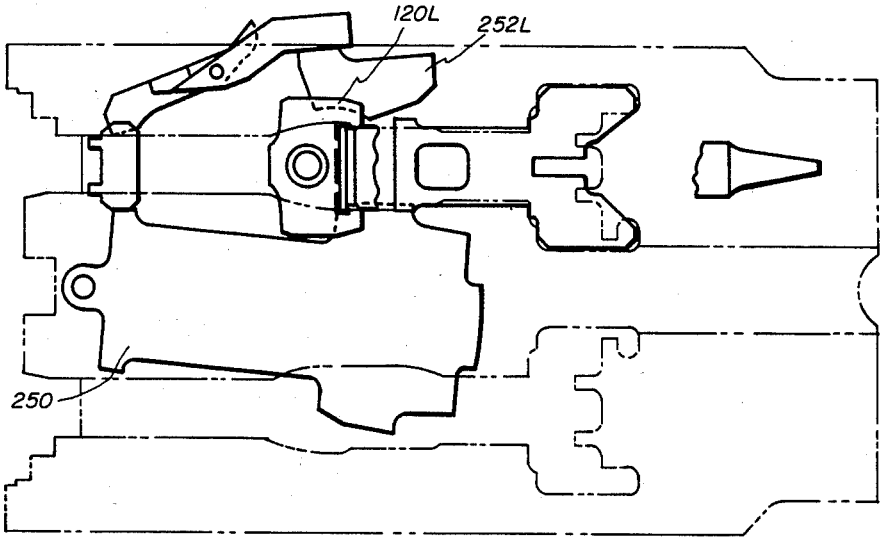
FIGS. 17 and 18 are similar to FIGS. 13 and 14 but show the round carried forward towards the chamber.
Figure 18:
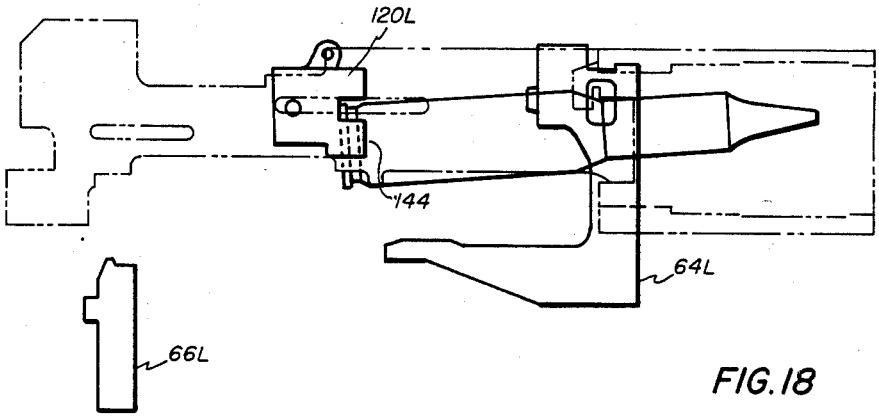

FIGS. 17 and 18 show the round being carried forward by the left gun bolt head which is carried forward by the left slider moving forward, via the accelerator link. The round is nosed upwardly at about 1° to the axis of the gun barrel and is guided by the left concave lateral guide surface 280L on the center guide assembly and a concave guide surface 281L in the breech housing 12 which slope upwardly at about 1° to the axis of the gun barrel. An additional pair of mutually facing, upward sloping guide surfaces 281LL and 281LR are positioned further forward on the breech housing 12 to continue guidance of the round as it is moved forward.

Figure 19:
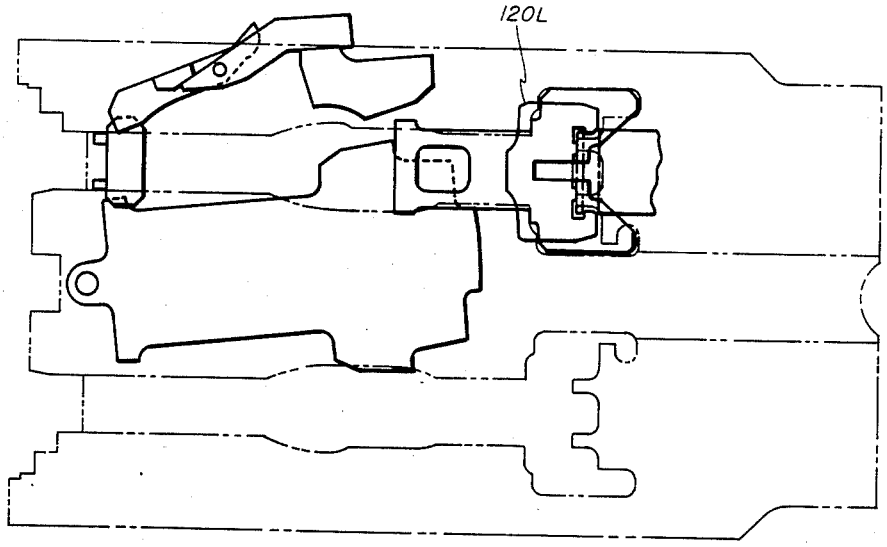
FIGS. 19 and 20 are similar to FIGS. 13 and 14 but show the round chambered and the bolt locked.
Figure 20:
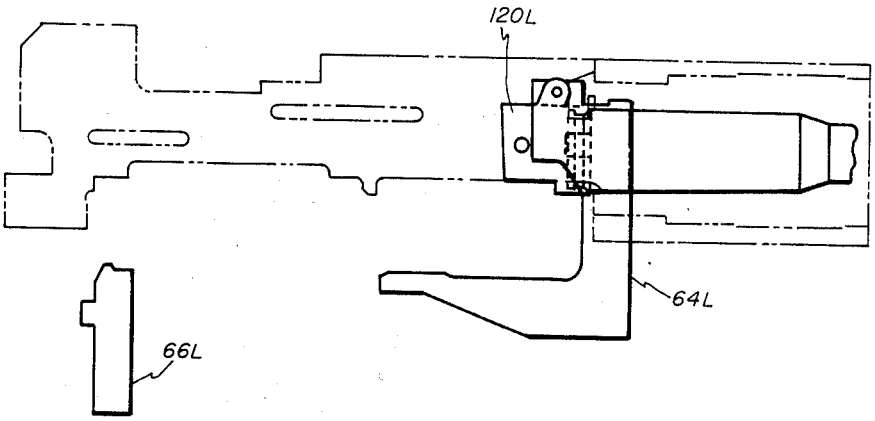

FIGS. 19 and 20 show the round chambered and locked into the left gun barrel by the left gun bolt head which has been carried forward by the still moving forward left slider. As the bolt head moved forwardly, the lugs 78L/R of the left forward stripper respectively entered the channels 172L/R grooves in the bolt head, and, thereafter, the left slider pulled the left forward stripper, and therewith the left bolt head, downwardly, into the bolt head locked disposition. Meanwhile, the right gun bolt head moving aftwardly, has disengaged the detent and switched the center guide assembly into its left hand disposition.

Figure 21:
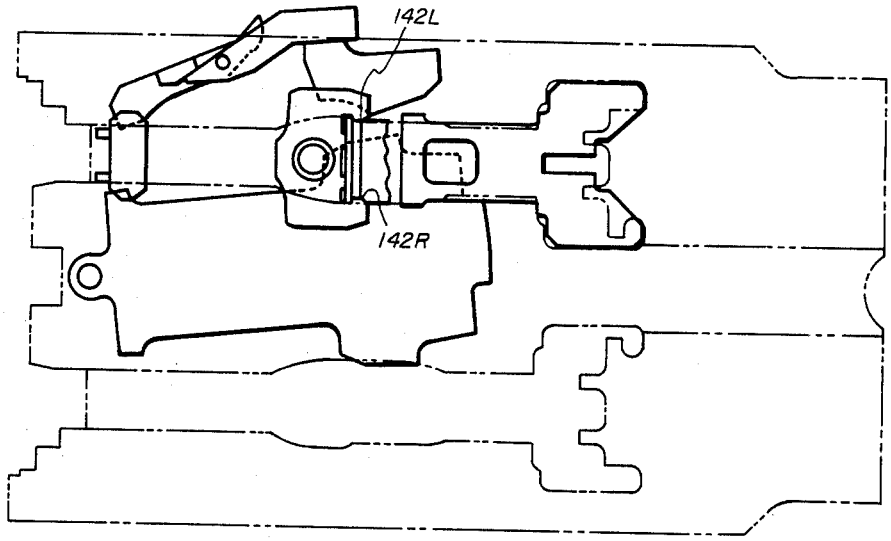
FIGS. 21 and 22 are similar to FIGS. 13 and 14 but show the fired case extracted and the bolt half-way towards aft dwell.
Figure 22:
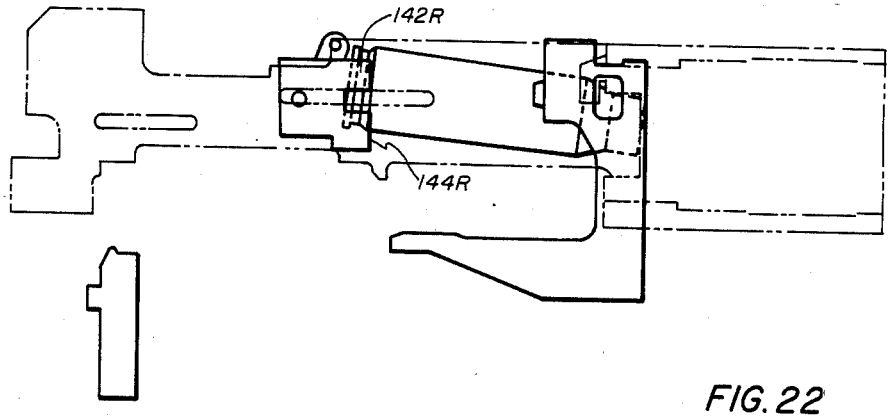

FIGS. 21 and 22 show the fired cartridge case during extraction, (after the chambered and locked round has been fired). As the left bolt head moves aftwardly, driven by left slider via the left accelerator link, the extractor disk of the fired cartridge case rides onto the concave upper guide surface 278L of the center guide assembly and is thereby cammed upwardly along the face of the gun bolt so that while initially engaged with the lower extractor lugs 144L/R and aligned with a pair of mutually facing, concave guide surfaces 283LL and 283LR in the breech housing 12 which are parallel to and spaced vertically above the axis of the gun barrel, engagement of the extractor disk transfers to the upper extractor lugs 142L/R as the bolt moves aftwardly. The left bolt head subsequently disengages the detent and shifts the center guide assembly to its right hand disposition as shown in FIG. 23.

Figure 23:
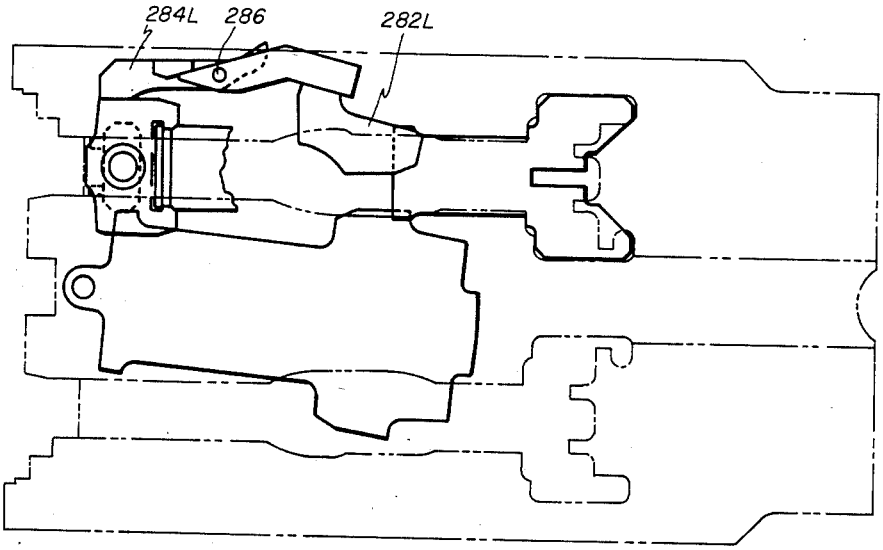
FIGS. 23 and 24 are similar to FIGS. 13 and 14 but show the fired case extracted and the bolt seven-eighths towards aft dwell.
Figure 24:
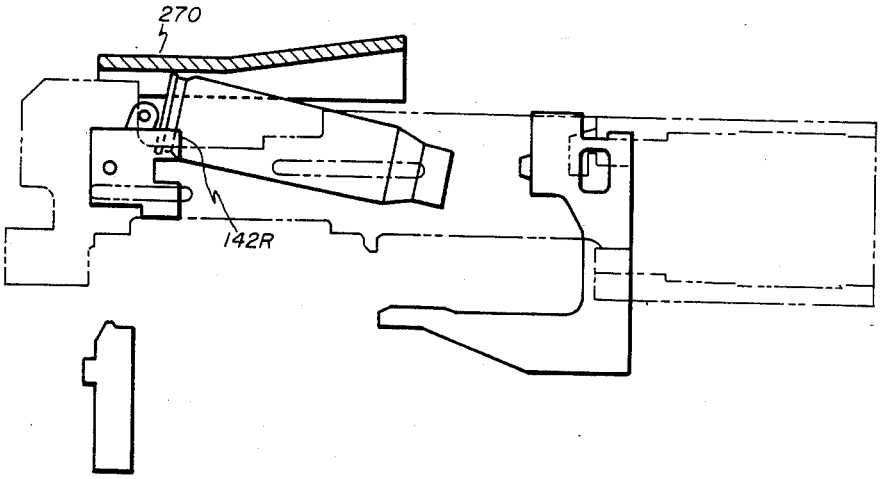

FIGS. 23 and 24 show the fired cartridge case further extracted as the left bolt head continues to travel aftwardly. The left bolt head abuts the aft end of the aft side guide 284 swinging this aft end outwardly (here shown clock-wise) about the pivot 286, and via the spring 288, swinging the forward end of the forward side guide 282 inwardly to strike, and spring yield, against the side of the extracted cartridge case, and subsequently to swing in further under and to push upwardly the shoulder of the extracted cartridge case, and overlie the next round which is to be stripped from its link and is lying on the transverse guide 236. An ejector guide 270 is bolted to the breech housing and limits upward movement of the base of the round on the bolt face.

Figure 25:
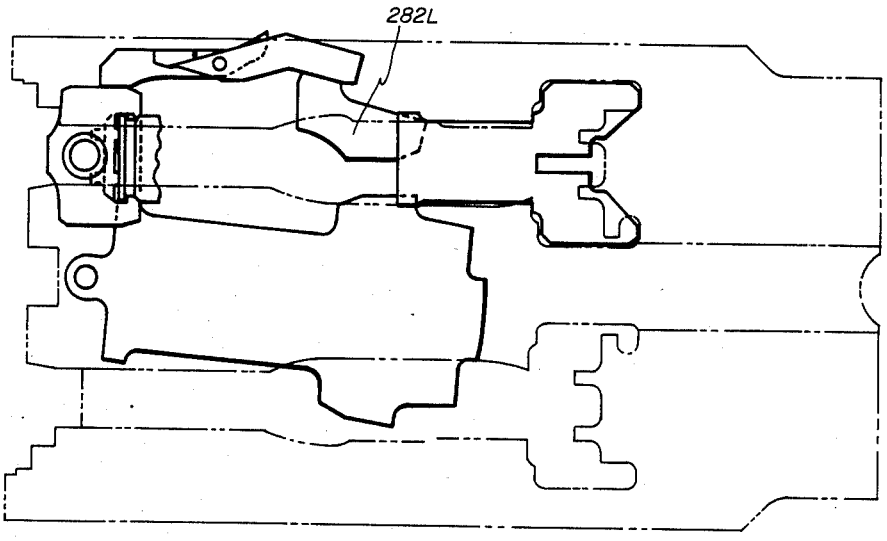
FIGS. 25 and 26 are similar to FIGS. 13 and 14 but show the fired case extracted and the bolt in aft dwell.
Figure 26:
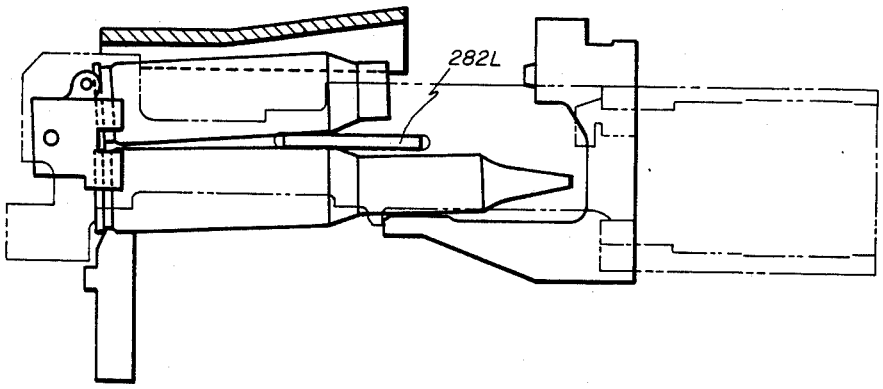

FIGS. 25 and 26 show the fired cartridge case fully extracted, still engaged with the upper extractor lugs of the left bolt head which is in rear dwell, and its base resting on laterally extending trackways (not visible) in the breech housing 12 and on the base of the nest round which has been stripped from its link (much as was shown in FIG. 16) and its shoulder resting on the side guide 282L. The slider is still moving aft and the center guide assembly is in its right hand disposition.

Figure 27:
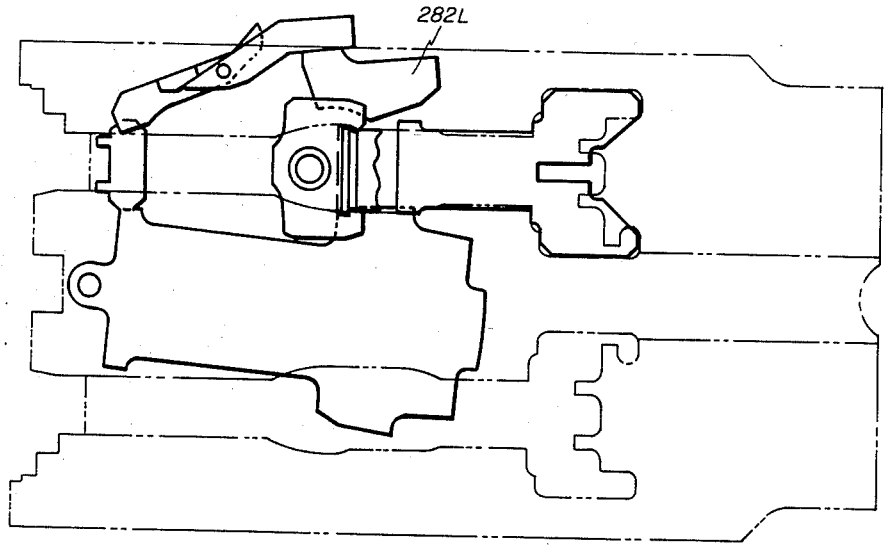
FIGS. 27 and 28 are similar to FIGS. 13 and 14 but show the fired case half-way ejected, leading to the fully ejected disposition shown in FIG. 11.
Figure 28:
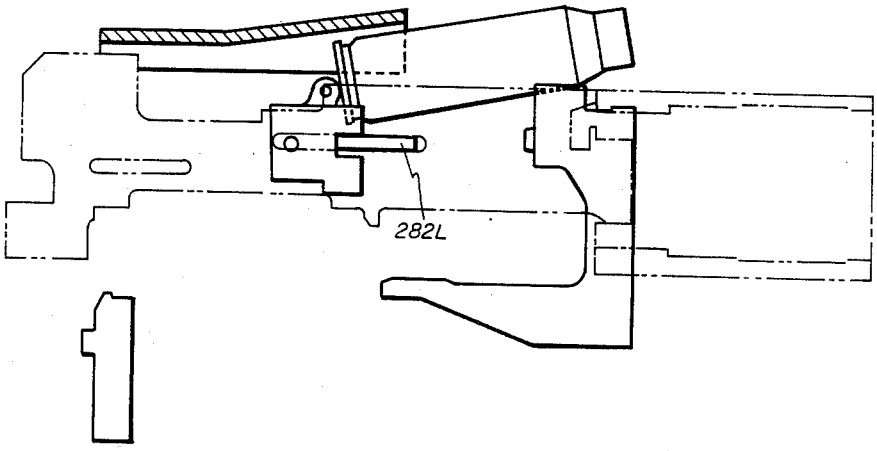

FIGS. 27 and 28 show the fired cartridge case being ejected. The extractor disk of the fired case is pushed upwardly off the face of the gun bolt by the upper face of the forward side guide 282L and an upper pair of mutually facing, concave guide surfaces 307LL and 307LR in the breech housing, as the gun bolt is moving forward from rear dwell in the disposition substantially as shown in FIGS. 17 and 18.

Figure 29:
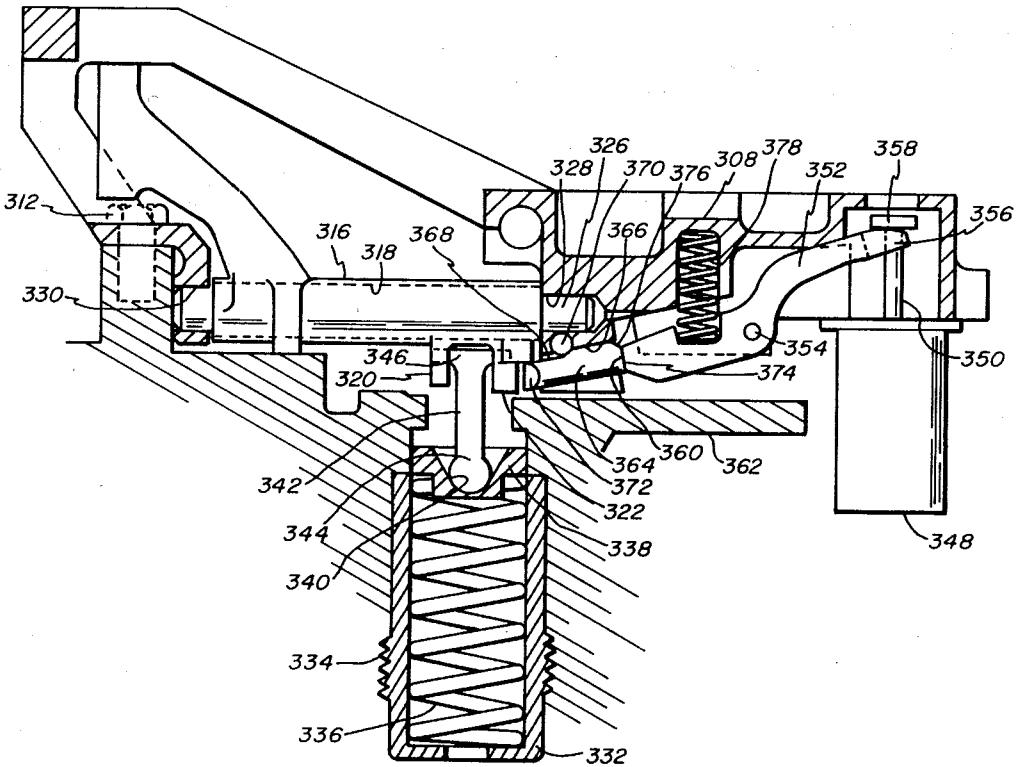
FIGS. 29 and 30 are a side view in elevation and an aft view looking forward in elevation respectively of the hammer assembly shown in the on-sear or safed disposition.
Figure 30:
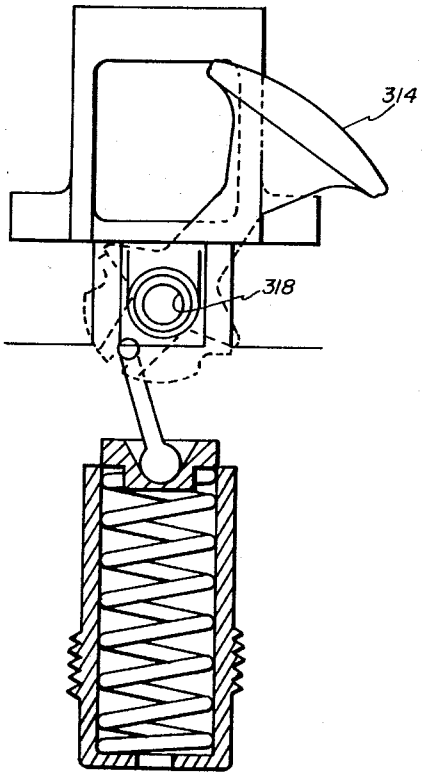
Figure 31:
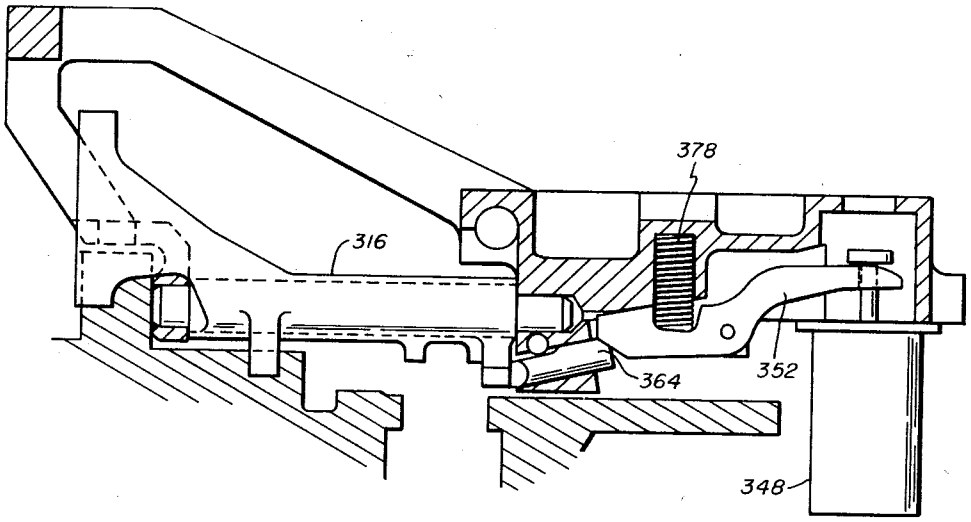
FIGS. 31 and 32 are similar to FIGS. 29 and 30 respectively, but show the hammer assembly in the off-sear or firing disposition.
Figure 32:
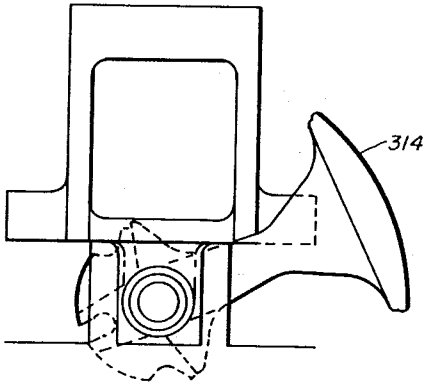

FIGS. 29 and 30 show the hammer assembly 30 in the on-sear or cocked disposition, while FIGS. 31 and 32 show the off-sear or fired disposition. The hammer assembly includes a hammer housing 308 which is secured to the breech housing 12 by two forward bolts 310 and one aft bolt 312. The hammer head 314 is integral with a hammer body 316 which has a longitudinal bore 318 and a substantially downwardly directed double clevis 320 and a forward facing concave cam 322 adapted to receive an aftwardly projecting sear 364. The hammer body 316 is journaled to the housing 308 by a hammer shaft 326 having a main portion which fits the bore 318, a reduced forward portion which fits a forward bore 328 and an enlarged aft portion which fits an aft bore 330.

A firing spring housing 332 is secured to the breech housing, as by mutual threads 334. The housing contains a helical compression firing spring 336, a spring follower 338 having a socket 340, a connecting link 342 having a knuckle 344 on its lower end riding in the socket 340 and a cross-bar 346 on its upper end riding in the double clevis 320.

A solenoid 348 is bolted to the hammer housing 308 and has an armature 350 which is pulled down into the housing when the solenoid is energized so that the gun may fire. The rate of fire may be controlled by pulsed energization of the solenoid. A sear control lever 352 is pivotally mounted to the hammer housing by a cross-pin 354 and has a bifurcated forward end 356 which-rides under the head 358 of the armature 350. The aft end of the lever has a nose with a flat face 360 which is substantially perpendicular to its radius to the pivot 354 and also has a sloping face 362. The sear pin 364 is disposed in a bore 366 in the hammer housing, and has a flat step 368 which rides under a cross-pin 370 to prevent the sear pin from rotating but which permits limited fore and aft movement of the sear pin. The sear pin has a wedge shaped aft end 372 which rides into the forward facing concave cam 322 of the hammer body 316, and has flat transverse face 374 adapted to abut the flat face 360 of the control lever and has a sloping face 376 adapted to be cammed by the sloping face 362 of the control lever. A helical compression spring 378 is captured between the hammer housing 308 and the sear control lever 352 and biases the lever 352 into its on-sear disposition as shown in FIG. 29 when the solenoid 348 is deenergized, so that the sloping surface 362 on the aft end of the lever cams against the sloping surface 376 on the forward end of the sear pin to push the sear pin 364 aftwardly until the lever snaps down so that the faces 360 and 374 are in abutment to hold the sear pin aft. When the sear pin is held aft, its aft wedge shaped end 372 is disposed within the forward facing concave cam 322 of the hammer body 316 and positively interferes with the downwardly directed swing, either clockwise or counter clockwise, of the hammer head 314, which is urged by firing spring 336 through the connecting link 342. However, when the solenoid 348 is energized, and pulls in its armature 350 to swing the forward end 356 of the control lever 352 downwardly against the bias of the sear spring 378 and to swing the aft end flat face 360 out of the path of the sear pin 364, the firing spring biases the hammer head downwardly and the forward facing concave cam 322 cams the wedge shaped aft end 372 of the sear pin 364 forwardly, out of the concavity of the cam 322, so that the hammer head is free to swing downwardly.

Figure 33:
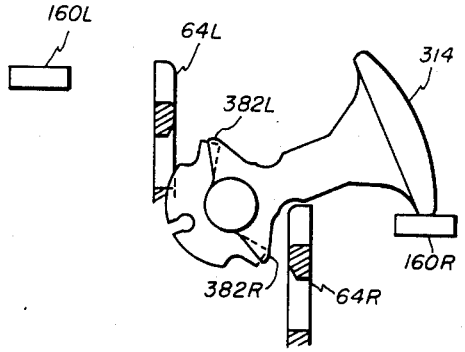
FIGS. 33 through 37 are detail aft views of the hammer, the left and right hand forward strippers and the respective tail portions of the left and right hand firing pins, showing their cooperation during various stages of the gun operating cycle.

The various positions of the hammer head 314 are shown, (looking forward from aft,) in FIGS. 33 through 37. FIG. 33 shows the hammer head, at the time of firing the right hand gun barrel, impacting the head 160R of the right hand firing pin 158R of the right hand gun bolt head assembly 120R. The hammer head is clear of the right forward stripper 64R, the left forward stripper 64L, and the head 160L of the left hand firing pin 158L.

The hammer head has a left hand safety sear surface 382L and a right hand safety sear surface 382R whose respective function is to ensure that the respective gun bolt head is safely locked, i.e., the locking lugs 173*a, b, c* and on the aft face of the gun bolt head and the respective locking lugs 174*a, b, c* and *d* on the breech housing are adequately, but not totally, mutually engaged, before the hammer head is otherwise clear to be driven fully downwardly to impact the respective firing pin.

Figure 34:
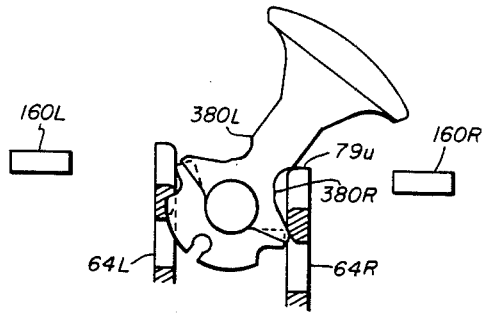
Figure 35:
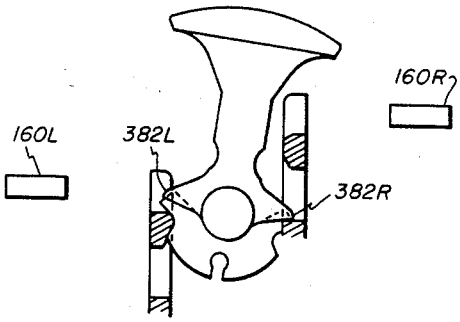
Figure 36:
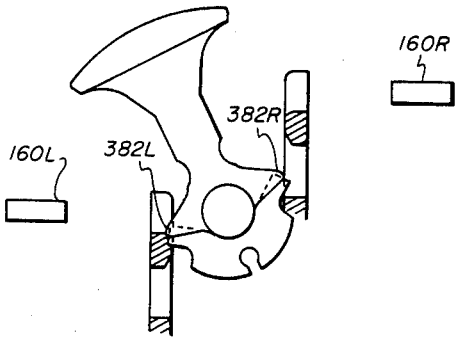
Figure 37:
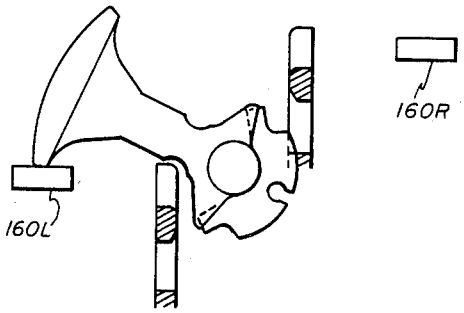

FIG. 34 shows the right hand gun bolt fired and fully unlocked. The hammer upper camming surface 79U of the right forward stripper 64R engages a right hand camming surface 380R and as the stripper is raised by the slider 44R, the stripper cams the hammer counter-clockwise against the bias of the firing spring 336. As the hammer upper cammming surface looses engagement with the hammer, the stripper lower camming surface 79D engages the right hand safety sear surface 382R and continues to cam the hammer counter-clockwise as shown in FIG. 35 until the hammer goes over-center as shown in FIG. 36, and the firing spring 336 drives the hammer further counter-clockwise until the safety sear surface 382L arrests further rotation until the gun bolt is safely locked as described above, after which the hammer is driven further counter-clockwise to impact the head 160L of the left hand firing pin 158L of the left hand gun bolt head assembly 120L as shown in FIG. 37.

Figure 38:
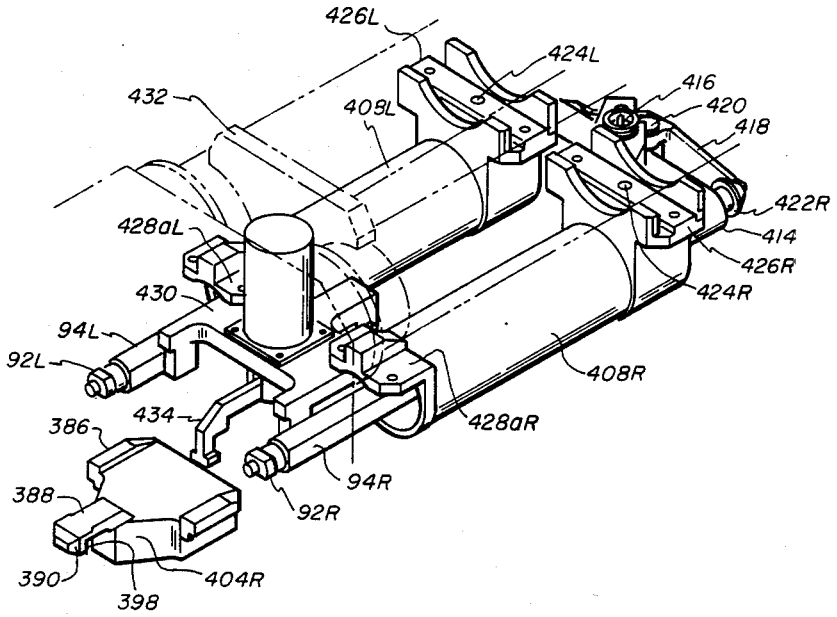
FIGS. 38 and 39 are a perspective view and a detail side view in elevation respectively of the gas drive and clearing assembly, showing the assembly in its deenergized or cleared disposition.
Figure 39:
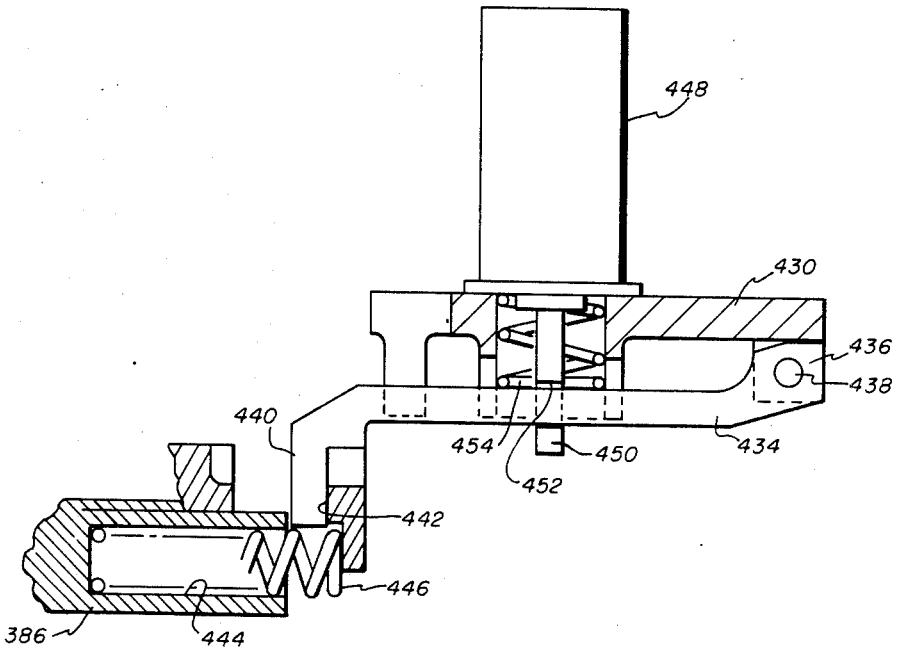

The gas drive and clearing assembly are shown in their deenergized or cleared disposition in FIGS. 38 and 39, and also shown in part in FIG. 4. A detent 386, which is mounted in the receiver housing 26 to slide fore and aft, has an aftwardly extending projection 388 with a depending foot 390 which projects into a recess 392 in the rocking lever 34. The recess 392 has an inner arcuate wall 394 which has a left and a right locking surface 396 L/R. The foot 390 has a forward facing locking surface 398 which rides against and along the surfaces 394, 396L and 396R. The rocking lever 34 also has a peripheral ridge 400 which terminates in two radially projecting blocking faces 402L/R which are respectively adapted to abut against either of two blocking surfaces 404L/R on the detent when the locking surface 398 is wedged against either locking surface 396L or 396R. Thus, when the rocking lever 34 is swung fully counter-clockwise beyond the disposition shown in FIG. 4, the detent surface 398 is cammed onto the surface 396R and the detent is pulled aftward and is simultaneously pushed aftward by three parallel springs 446 so that the peripheral face 402R is wedged against the detent surface 404L. For the face 402R to ride off the surface 404L, the detent must move forward. If such forward movement is precluded, the rocking lever is frictionally locked against rotation, and operation of the operating mechanism of the gun is halted. When the rocking lever is swung fully clockwise, and the detent surface 398 is cammed onto the surface 396L, a similar locking action is provided.

The gas drive and clearing assembly includes a left and a right cylinder 408L/R, each cylinder having a respective piston rod 94L/R, each rod having a respective aft end formed as the disk 92L/R, each disk adapted to fit the respective slot 90L/R in the forward end of the respective slider 44L/R. The forward ends of the cylinder are connected by a manifold block 414 which has a socket to receive a gas squib, or a plurality of squibs (not shown), whose upper end 416 is threaded to receive an electrical connector to enable the firing of the squib to provide gas under pressure in the manifold and thence to the cylinders. A rocker arm 418 is pivotally mounted at 420 to the manifold and is coupled to two pilot rods 422L/R which are respectively activated by the piston rods 94L/R at the forward end of their stroke to open a respective valve (not shown) in the manifold. Thus, when the right hand piston rod 94R is forward, the right hand pilot rod 422R is driven forward and opens the right hand valve to permit the flow of gas from the squib into the right hand piston 408R and swings the rocker arm 418 to close the left hand valve to preclude the flow of gas into the left hand piston 408L. The pistons also have respective gas bleed ports 424L/R which are aligned with corresponding gas bleed ports, not shown, in the gun barrels. The ports 424 are not controlled by the valves in the manifold and pass gas directly from the fired gun barrel into the respective gas cylinder to drive the respective pistion aftwardly to drive the respective slider aftwardly. The cylinders have respective forward mounting brackets, 426L/R which are bolted to a top clamp bracket 428 by four bolts to form the forwrad clamp assembly. The cylinders have respective aft mounting brackets 428aL/R which are bolted to a bracket 430 which is bolted to a top clamp bracket 432.

Figure 40:
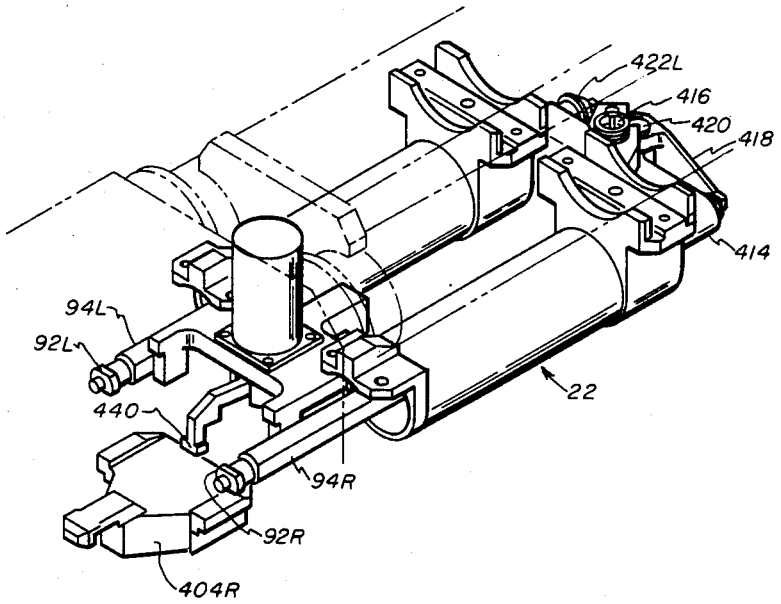
FIGS. 40 and 41 are similar to FIGS. 38 and 39 respectively, but showing the assembly in its energized or firing disposition.
Figure 41:
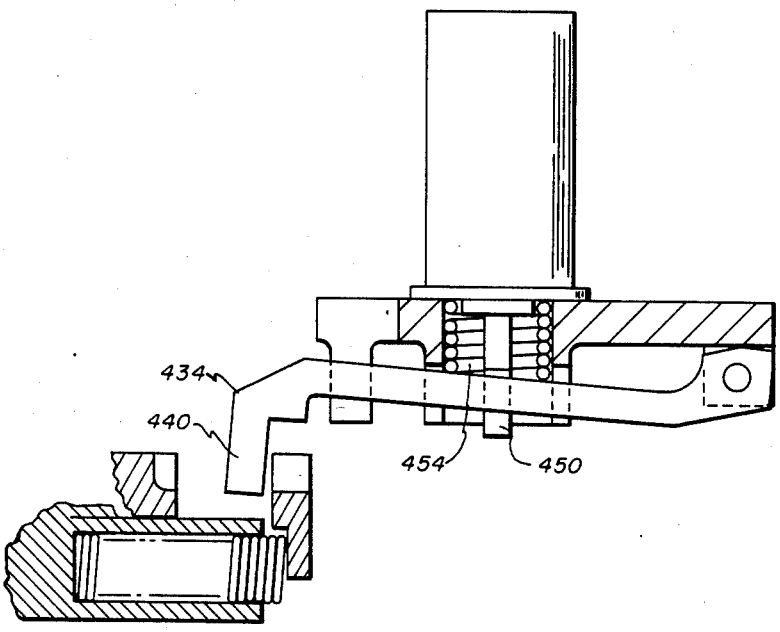

A clearing lever 434 has a clevis 436 at its forward end pivotally mounted at 438 to a tab depending from the bracket 430 and has a depending foot 440 at its aft end projecting through a slot 442 in the forward end of the receiver housing 26 adjacent the forward end of the detent 386. The detent 386 has three blind bores 444 therein, in each of which is disposed a respective helical compression spring 446 which is captured between the detent and the receiver housing and which biases the detent aftwardly. A clearing solenoid 448 is bolted to the bracket 430 and has an armature 450, with a notch 452 in its distal end which captures the clearing lever 434, and a helical compression spring 454 which biases the clearing lever and the armature downwardly. When the clearing lever 434 is biased downwardly, as shown in FIGS. 38 and 39, the depending foot 440 is disposed immediately forward of the detent 386 and precludes the detent from moving forwardly, which precludes the rocking lever from rotating, and thereby halts the operation of the gun, notwithstanding any gas pressure in either of the cylinders 408L/R, thus "safing" the gun by leaving a fired cartridge case in one of the barrels. When the clearing solenoid 448 is energized, as shown in FIGS. 40 and 41, it pulls up the armature 450 and the clearing lever 434, against the bias of the spring 454, to swing the depending foot 440 upwardly and out of the way of the detent 386, to permit the detent 386 to move forwardly against the bias of the springs 446, when gas pressure in either of the cylinders tends to cause the rocking lever to rotate, so that the detent thereby permits the rocking lever to rotate, thereby permitting operation of the gun. In this disposition, gas pressure in the pistons will reciprocate the sliders 44L/R, which will (1) oscillate the rocking lever 34, which will reciprocate the feeder arm 48, which will reciprocate the cam driver 58 which will drive the feeder sprocket, and (2) reciprocate the strippers and the gun bolt assemblies. If rounds have (1) been fed and stripped and loaded and locked, and (2) if the firing solenoid 348 has been energized, then the gun will fire.

Figure 43:
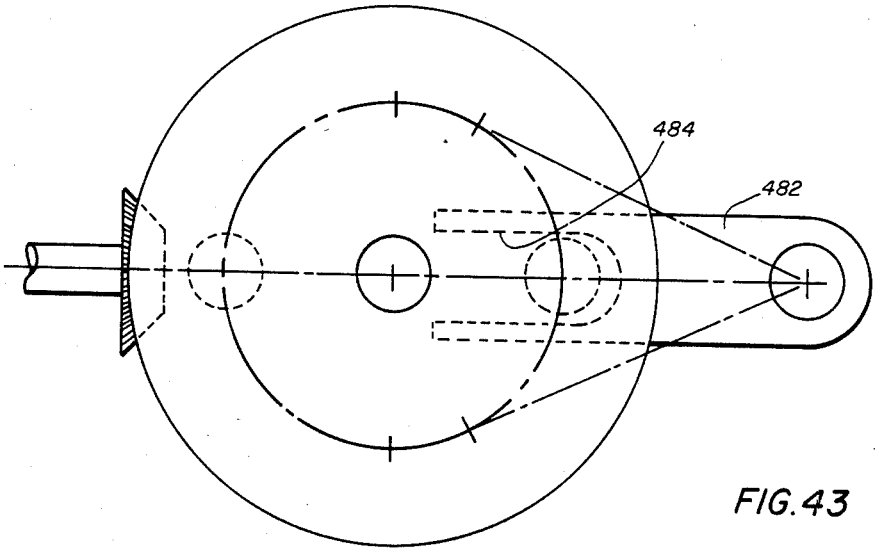
FIGS. 42 and 43 are a top view and a side view respectively in elevation of an external drive, and having a rotary input coupled to the operating mechanism.
Figure 42:
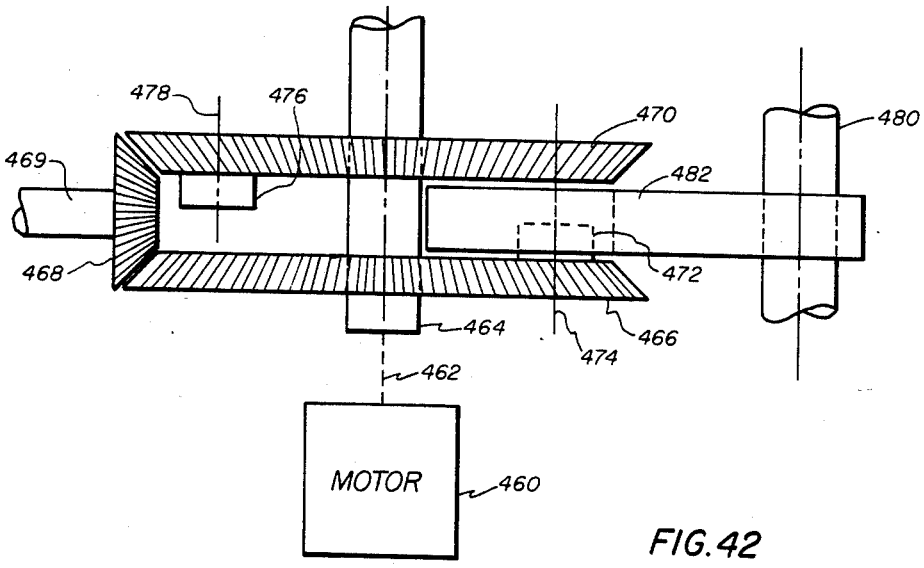

If it is desired to have the gun powered by an external source, rather than self-powered, as by the gas drive shown in FIGS. 38 and 40, then an external drive may be substituted as shown in FIGS. 42 and 43. The safing system, which includes the clearing solenoid 448, the clearing lever 434 and the detent 386, remains as shown in FIG. 39 to provide their functions. The external drive assembly includes an electric motor 460, fixed to the receiver housing, whose output shaft 462 is fixed to a shaft 464 which is fixed to a lower bevel gear 466. The gear 466 is meshed with a lateral bevel gear 468 fixed to a shaft 469 and which is meshed with an upper bevel gear 470, which is journaled for rotation with respect to the shaft 464. A lower cam roller 472 is journaled for rotation on a stub shaft 474 which is carried by the lower gear 466. An upper cam roller 476 is journaled for rotation on a stub shaft 478 which is carried by the upper gear 470. A shaft 480 is splined to the central post 36, shown in FIG. 4, which post is fixed to the rocking lever 34. A bifurcated cam follower 482 is fixed to the shaft 480 and its bifurcation projects between the gears 466 and 470 so that the rollers 472 and 476 may ride into and out of the cleft cam following surface 484 of the bifurcation. The shafts 464, 469, and 480 are each respectively supported by stationary journals, (not shown.)

As viewed in FIG. 42, the electric motor 460 drives the shaft 464 with the gear 466 counter-clockwise so that the roller 472 is carried counter-clockwise and swings the bifurcated cam follower 482 with the shaft 480 and the rocking lever 34 clockwise until the roller 472 exits the cleft 484 and the swing of the follower 482 halts. Meanwhile, the gears 466 and 468 drive the gear 470 clockwise until it enters the cleft 484 and swings the follower 482, and thereby, the rocking lever 34 counter-clockwise until the roller 476 exits the cleft 484 and the swing of the follower 482 halts until the roller 472 reenters the cleft, and so on.

Figure 44:
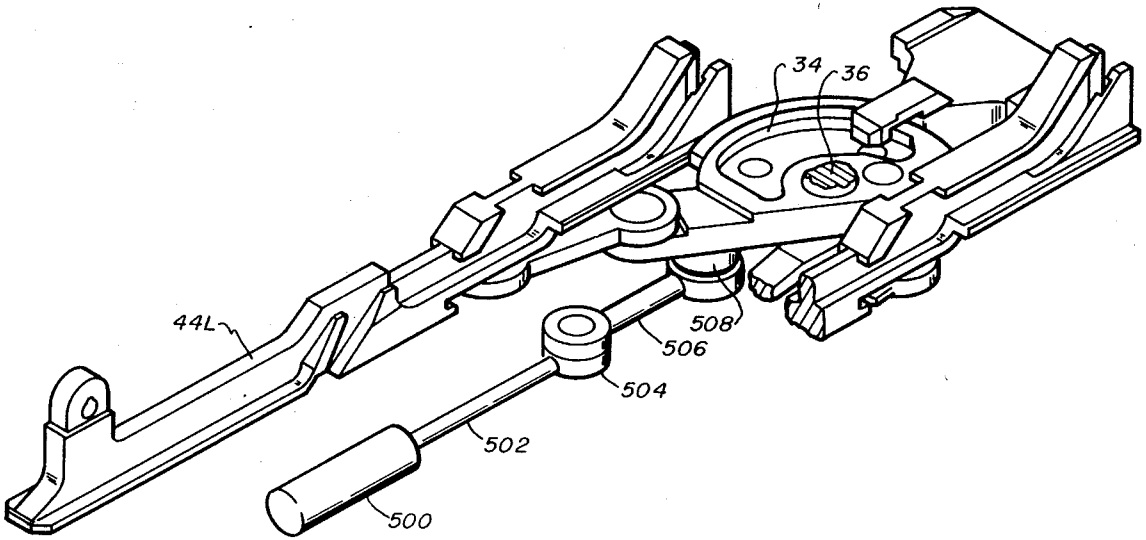
FIG. 44 is a perspective view, similar to FIG. 4, showing an external drive having a rectilinear, reciprocating input coupled to the operating mechanism.

Alternatively, an external drive may be substituted as shown in FIG. 44. This external drive assembly includes a double acting cylinder 500 having a piston 502 whose forward end is connecting by a pivotable joint 504 to a journal rod 506 which is journaled on a post 508 which is fixed to and depends from the underside of the rocking lever 34 and is eccentric to the central post 36. Aftward movement of the piston 502 pulls the rocking lever through the disposition shown in FIG. 44 to bring the left slider 44L into its aft disposition. Forward movement of the piston 502 pushes the rocking lever to bring the right slider 44R into its aft disposition.

What is claimed is:

1. A machine gun comprising:

a receiver;

a pair of gun barrels fixed to said receiver;

a pair of operating and gunbolt mechanisms disposed in said receiver for loading, locking and firing each of said gun barrels respectively;

a rocking lever coupled to and between said operating mechanisms for driving said mechanisms 180° out of mutual phase;

said rocking lever journaled for pivotal movement about a central axis; and external drive means coupled to said rocking lever for reciprocating said lever about said axis including a motor having an output shaft which is coupled through an intermittent drive mechanism to a shaft fixed to said lever on said axis.

2. A machine gun comprising:

a receiver;

a pair of gun barrels fixed to said receiver:

a pair of operating mechanisms disposed in said receiver for enabling loading, locking and firing each of said gun barrels respectively;

a rocking lever coupled to and between said operating mechanism for driving said mechanisms 180° out of mutual phase, and journaled for pivotal movement about a central axis;

each of said operating mechanisms including:

a gun bolt;

a slider coupled to said rocking lever for fore and aft rectilinear reciprocation as said lever reciprocates about its said central axis; and a forward stripper and an aft stripper each supported to be cammed transversely up and down by said slider during the course of said reciprocation of said slider;

said aft and forward strippers serving to strip rounds of ammunition from a linked belt of ammunition;

said forward stripper serving to lock said respective gun bolt.

3. A machine gun according to claim 2 wherein:

said pair of gun bolts are respectively coupled to a pair of accelerating linkages, which are each respectively coupled to said respective slider in said pair of operating mechanisms, whereby said respective slider drives said coupled thereto gun bolt fore and aft to load a round of ammunition, and said respective forward stripper locks and unlocks said gun bolt, during the course of said reciprocation of said slider.

4. A machine gun according to claim 3 wherein:

each gun bolt has a bolt head which carries a respective firing pin which is mounted on a pivot within a cavity in said bolt head on a pivotal axis which is transverse to the longitudinal axis of the respective gun barrel;

said firing pin has a head projecting aftwardly from said pivot and a leg depending from said pivot and terminating in a penetrator tip which projects forwardly through a bore leading from said cavity to the face of the gun bolt.

5. A machine gun according to claim 4 further comprising:

a hammer assembly having a hammer head mounted to swing to and between one disposition whereat it strikes the head of one of said firing pins when the respective one bolt head is in its locked disposition and another disposition whereat it strikes the head of the other of said firing pins when the respective other bolt head is in its locked disposition;

each firing pin when struck by said hammer mounted to swing its penetrator forwardly beyond the face of the gun bolt into the primer cup of a round of ammunition captured on the face of the gun bolt;

said penetrator having a taper such that it forms a tapered cavity in the primer cup whose surface will cam the penetrator aftwardly behind said bolt face upon transverse movement of the round along said bolt face.

6. A machine gun according to claim 3 wherein:

each of said gun bolts is coupled to a respective accelerating linkage by a quick-release pivotal connection including a clevis and a crosspin formed in an end of one of the components comprising the group of bolt and accelerating linkage, and a hook and a spring loaded closure therefor, both formed in an end of the other of the components in said group, said hook supported to enter said clevis and engage onto said crosspin, said closure supported to capture said hook onto said crosspin.

7. A machine gun comprising:

a receiver;

a pair of gun barrels fixed to said receiver;

a pair of operating mechanisms disposed in said receiver for loading, locking and firing each of said gun barrels respectively;

a rocking lever mounted for oscillation;

each of said operating mechanisms including:

a slider coupled to said rocking lever and mounted for fore and aft reciprocation in response to said oscillation;

a gun bolt assembly coupled to said slider and mounted for fore and aft reciprocation in response to said reciprocation of said slider;

a locking element cooperating with said slider and mounted for transverse reciprocation in response to said reciprocation of said slider for engaging and disengaging said gun bolt assembly in a forward disposition thereof and for transversely shifting said gun bolt assembly to and between and unlocked and locked disposition.

8. A machine gun according to claim 7 further including:

a sprocket for advancing a belt of linked ammunition; and wherein said locking element is a forward stripper and each of said operating mechanisms includes said forward stripper and an aft stripper, both cooperating with said slider and mounted for transverse reciprocation in response to said reciprocation of said slider for stripping a round of ammunition from a belt of linked ammunition in said sprocket.

9. A machine gun according to claim 8 wherein:

the pitch of the tips of the teeth of said sprocket is greater than the pitch of the belt of linked ammunition.

10. A machine gun according to claim 8 wherein:

said sprocket is mounted to a first shaft;

said first shaft is releasably coupled to and driven by a second shaft;

said second shaft is coupled by a one-way clutch to a drum cam;

said drum cam is driven by a cam driver assembly which is coupled to and driven by said rocking lever, whereby oscillation of said rocking lever intermittently rotates said sprocket in a first direction to advance the belt of ammunition, and decoupling said first shaft from said second shaft permits rotation of said sprocket in a second direction opposite to said first direction.

11. A machine gun according to claim 7 wherein:

each of said gun bolt assemblies includes:

a gun bolt head;

a firing pin pivotally mounted to said gun bolt head; and a hammer assembly which includes:

a hammer head mounted to swing to and between one disposition whereat it strikes one of said firing pins when the respective one bolt head is in its locked disposition and another disposition whereat it strikes the other of said firing pins when the respective other bolt head is at its locked disposition;

said locking element blocking said hammer head from striking its respective bolt head until said locking element has engaged and shifted its respective bolt head to its locked disposition.

12. A machine gun comprising:

a receiver;

a pair of gun barrels fixed to said receiver;

a pair of operating and gun bolt mechanisms disposed in said receiver for loading, locking and firing each of said gun barrels respectively;

a rocking lever coupled to and between said operating and gun bolt mechanisms for driving said mechanisms 180° out of mutual phase;

a clearing mechanism including:

detend means having a first disposition whereat said detent means engages said rocking lever to preclude rocking thereof and a second disposition permitting rocking thereof;

spring means normally biasing said detent to its first disposition;

blocking means having a first disposition whereat said blocking means blocks said detent means from shifting from said first disposition to said second disposition;

additional spring means normally biasing said blocking means to its first disposition;

solenoid means having a deenergized disposition for permitting said blocking means to be disposed by said additional spring means in its first disposition and having an energized disposition for shifting said blocking means to its second disposition.

* * * * *